US007953357B2

(12) United States Patent
Tanaka et al.

(10) Patent No.: US 7,953,357 B2
(45) Date of Patent: May 31, 2011

(54) IMAGE HEATING APPARATUS

(75) Inventors: Masashi Tanaka, Susono (JP); Kenichi Ogawa, Numazu (JP); Satoshi Nishida, Numazu (JP); Daisuke Aoki, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 189 days.

(21) Appl. No.: 12/363,429

(22) Filed: Jan. 30, 2009

(65) Prior Publication Data

US 2009/0196664 A1 Aug. 6, 2009

(30) Foreign Application Priority Data

Feb. 1, 2008 (JP) ..... 2008-022717
Dec. 25, 2008 (JP) ..... 2008-330372

(51) Int. Cl.
*G03G 15/20* (2006.01)

(52) U.S. Cl. ..... 399/327; 399/331

(58) Field of Classification Search ..... 399/325, 399/326, 327, 330, 331, 335; 219/216
See application file for complete search history.

(56) References Cited

U.S. PATENT DOCUMENTS 6,173,136 B1 * 1/2001 Fuchiwaki et al. ..... 399/67
6,411,785 B1 6/2002 Ogawahara
6,763,205 B2 * 7/2004 Izawa et al. ..... 399/69
6,985,689 B2 * 1/2006 Nanataki et al. ..... 399/330
7,107,001 B2 * 9/2006 Kameda ..... 399/328
7,155,136 B2 * 12/2006 Nihonyanagi et al. ..... 399/69
7,162,194 B2 * 1/2007 Hotta et al. ..... 399/328
7,190,914 B2 * 3/2007 Nihonyanagi et al. ..... 399/67
7,200,355 B2 * 4/2007 Uchiyama et al. ..... 399/333
7,603,069 B2 * 10/2009 Yamana et al. ..... 399/328
7,650,105 B2 * 1/2010 Ogawa et al. ..... 399/327

FOREIGN PATENT DOCUMENTS

JP 63137264 A * 6/1988
JP 3-65167 6/1991
JP 08110729 A * 4/1996
JP 10074012 A * 3/1998
JP 10319765 A * 12/1998
JP 11190952 A * 7/1999
JP 2001-154529 6/2001
JP 2002-236426 8/2002
JP 2003-186327 7/2003
JP 2007304414 A * 11/2007

* cited by examiner

*Primary Examiner* — Robert Beatty
(74) *Attorney, Agent, or Firm* — Canon USA Inc IP Division

(57) ABSTRACT

An image heating apparatus includes a contact-sliding member parallel to a generatrix of a heating roller and brought into contact with the heating roller configured to heat a toner image on a recording material. An inlet space and an outlet space are formed at the upstream and downstream ends, respectively, of a contact area. A cleaning member, provided on the downstream side of the contact area, cleans the surface of the heating roller to remove toner and paper dust from the surface of the heating roller.

2 Claims, 16 Drawing Sheets

IMAGE HEATING APPARATUS

BACKGROUND OF THE INVENTION

1. Field of the Invention

The present invention relates to an image heating apparatus that can operate as a heating fixing apparatus (fixing device) installable in an image forming apparatus, such as an electrophotographic copying machine, an electrophotographic printer, or the like.

2. Description of the Related Art

An external heating type fixing apparatus is known as a heating fixing apparatus (fixing device) installable in an electrophotographic copying machine or a printer. The external heating type fixing apparatus includes a heating member (e.g., a heater), a fixing roller heated by the heating member, and a pressing roller contacting the fixing roller to form a nip portion. As discussed in Japanese Patent Application Laid-Open No. 2003-186327, this type of fixing apparatus conveys a recording material carrying an unfixed toner image so that the surface carrying the toner image faces the fixing roller, while the recording material is held at the nip portion and heated by the heating member. Thus, the unfixed toner image on the recording material can be heated and fixed on the recording material.

The external heating type fixing apparatus is roughly classified into a contact-type fixing apparatus that causes the heating member to directly contact an outer circumferential surface of the fixing roller, and a non-contact type fixing apparatus that uses a halogen heater or another non-contact type heating member capable of heating the surface of the fixing roller. When the external heating type fixing apparatus is a contact-type, a heating member (e.g., a ceramic heater) directly contacts the surface of the fixing roller to transfer heat. Therefore, the heat transfer efficiency of the contact-type fixing apparatus is high compared to that of the non-contact type fixing apparatus.

Moreover, the external heating type fixing apparatus of the contact-type is roughly classified into a sliding contact-type fixing apparatus and a movable contact-type fixing apparatus. The sliding contact-type fixing apparatus includes a heating member, which is brought into contact with the surface of a fixing roller and is slidable. The movable contact-type fixing apparatus includes a heating film, which is heated by a heating member and moves together with the surface of a fixing roller, as discussed in Japanese Patent Application Laid-Open No. 2002-236426.

In these fixing apparatuses, when an unfixed toner image on a recording material (e.g., recording paper) is fixed, a small amount of dirt (offset toner, paper dust, etc.) adheres to the outer circumferential surface of a fixing member (e.g., the fixing roller, a fixing film, etc.). If the dirt remains on the surface of the fixing member due to repeated printing, the dirt may be transferred from the fixing member to recording paper and generate a defective image.

Therefore, as discussed in Japanese Patent Application Laid-Open No. 3-65167, a cleaning blade capable of scraping the dirt off the surface of the fixing member can be provided. As discussed in Japanese Patent Application Laid-Open No. 2001-154529, a cleaning weave capable of wiping the dirt off the surface of the fixing member can be provided. The cleaning blade and the cleaning weave can remove the dirt off the surface of the fixing member, and can reduce generation of a defective image.

However, if the above-described conventional fixing apparatus uses the cleaning blade to clean the surface of the fixing member, the cleaning by the cleaning blade may be insufficient and a defective image may be generated. As described above, when the unfixed toner image on a recording paper is fixed, a small amount of dirt (offset toner, paper dust, etc.) adheres to the surface of the fixing member.

The cleaning blade, when it is used to clean the surface of the fixing member, can collect the paper dust or any dirt stable against the heat from the fixing member. However, the toner or another dirt that melts by the heat from the fixing member may pass through the blade. If the fixing apparatus uses a cleaning pad (felt, unwoven fabric, etc.) to clean the surface of the fixing member, the toner melted by the heat from the fixing member may partly pass through the cleaning pad and may be discharged to the surface of the fixing member. The toner discharged on the surface of the fixing member is transferred to a subsequent recording paper conveyed by the fixing nip portion and soils an image on the subsequent recording paper.

On the other hand, when the fixing apparatus uses a cleaning weave to clean the surface of the fixing member, the cleaning weave can periodically change its cleaning surface to prevent the melted toner from passing through the cleaning weave. However, the configuration of the fixing apparatus becomes complicated and the cost of the fixing apparatus increases.

SUMMARY OF THE INVENTION

Exemplary embodiments of the present invention are directed to an image heating apparatus capable of preventing dirt from accumulating on the surface of a rotatable heating member.

According to an aspect of the present invention, an image heating apparatus for heating a toner image formed on a recording medium includes a heating roller configured to contact the toner image on the recording medium to heat the toner image; a heating source configured to heat the heating roller; a back-up member configured to contact a surface of the heating roller to form a heating nip portion together with the heating roller, so that the recording medium is held between the heating roller and the back-up member and conveyed in a predetermined conveyance direction; a contact-sliding member having a length in a direction parallel to a generatrix of the heating roller, which is not smaller than the width of a maximum recording medium that can be processed by the image heating apparatus, and configured to contact the surface of the heating roller, wherein a contact surface of the contact-sliding member contacting the surface of the heating roller is a non-movable surface, wherein an inlet space is formed between the surface of the heating roller and the contact surface of the contact-sliding member on the upstream side of a contact area between the surface of the heating roller and the contact-sliding member in the rotational direction of the heating roller, and an outlet space is formed between the surface of the heating roller and the contact surface of the contact-sliding member on the downstream side of the contact area in the rotational direction; and a cleaning member positioned on the downstream side of the outlet space and on the upstream side of the heating nip portion in the rotational direction and configured to contact the surface of the heating roller.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments and features of the invention and, together with the description, serve to explain at least some of the principles of the invention.

DETAILED DESCRIPTION OF THE EMBODIMENTS

Figure 1:
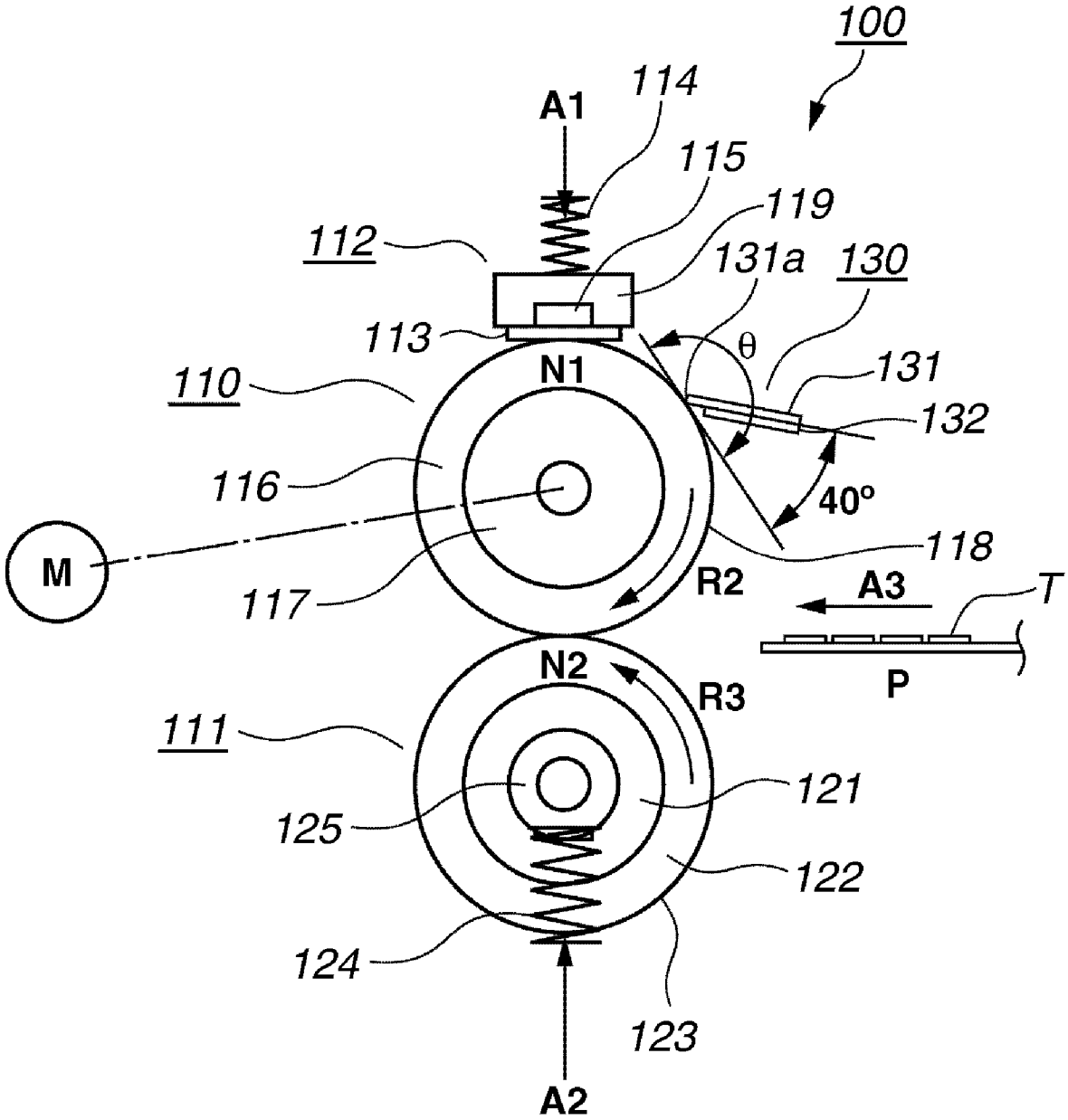
FIG. 1 is a cross-sectional view illustrating a main portion of a fixing apparatus according to a first exemplary embodiment of the present invention.

The following description of exemplary embodiments is illustrative in nature and is in no way intended to limit the invention, its application, or uses. Processes, techniques, apparatus, and systems as known by one of ordinary skill in the art are intended to be part of the enabling description where appropriate. It is noted that throughout the specification, similar reference numerals and letters refer to similar items in the following figures, and thus once an item is described in one figure, it may not be discussed for following figures. Exemplary embodiments will be described in detail below with reference to the drawings.

Figure 12:
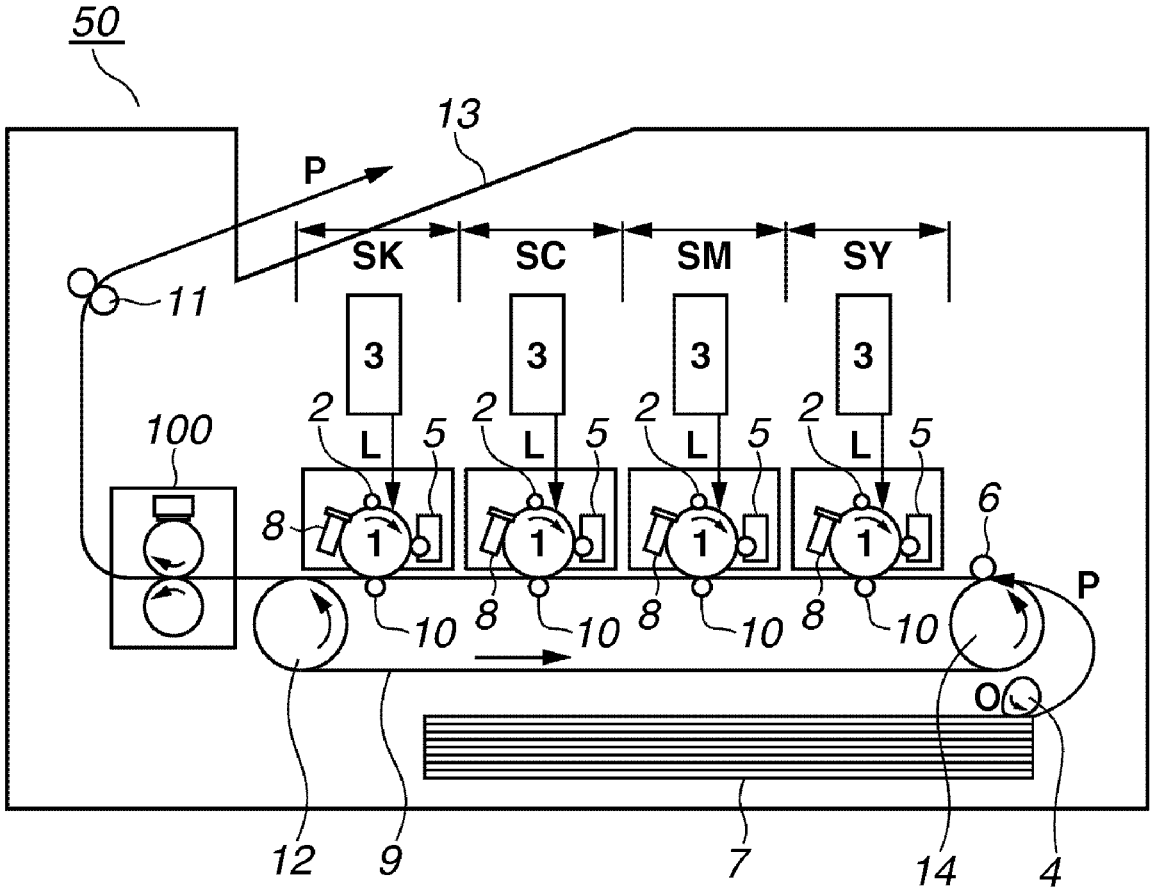
FIG. 12 illustrates an example configuration of an image forming apparatus according to an exemplary embodiment of the present invention.

FIG. 12 illustrates an example configuration of an image forming apparatus, which can incorporate an image heating apparatus according to an exemplary embodiment of the present invention, as a heating fixing apparatus (fixing device). The image forming apparatus is an electrophotographic full-color laser printer.

The image forming apparatus 50 according to the present exemplary embodiment includes first to fourth image forming stations SY, SM, SC, and SK, which can form yellow (Y), magenta (M), cyan (C), and black (K) toner images. Each of the image forming stations SY, SM, SC, and SK includes a drum type electrophotographic photosensitive member (hereinafter, referred to as "photosensitive drum") 1, which can operate as an image carrier. A charging device 2 operable as a charging unit, an exposure apparatus 3 operable as an exposure unit, a developing device 5 operable as a developing unit, a drum cleaner 8 operable as a cleaning unit are disposed around the photosensitive drum 1 along the rotational direction of the photosensitive drum 1.

An endless recording material conveyance belt 9 operable as a recording material conveyance unit is provided in a confronting relationship with the outer circumferential surface of the photosensitive drum 1 of respective image forming stations SY, SM, SC, and SK. The recording material conveyance belt 9 is stretched around two roller shafts (i.e., a driving roller 12 and a tension roller 14). The recording material conveyance belt 9 is made of a dielectric resin material, which can hold a recording material P with an electrostatic force. A transfer roller 10 operable as a transfer unit is disposed in a confronting relationship, via the recording material conveyance belt 9, with the photosensitive drum 1 of respective image forming stations SY, SM, SC, and SK. Thus, a contact portion between the photosensitive drum 1 and the recording material conveyance belt 9 can serve as a transfer portion.

The image forming apparatus according to the present exemplary embodiment executes a predetermined image formation sequence in response to a print signal supplied from a host computer or another external apparatus (not illustrated), and performs an image forming operation according to the image formation sequence. Each photosensitive drum 1 rotates in an arrow direction at a predetermined circumferential speed (process speed). The recording material conveyance belt 9 is driven by the driving roller 12 and travels in an arrow direction at a traveling speed corresponding to the circumferential speed of the photosensitive drum 1.

First, at the yellow (first color) image forming station SY, the charging device 2 uniformly charges the surface of the photosensitive drum 1 to have a predetermined polarity and a predetermined electric potential. In the present exemplary embodiment, the surface of the photosensitive drum 1 has a negative polarity. Next, the exposure apparatus 3 scans and exposes a charging surface of the photosensitive drum 1 to a laser beam L emitted based on image information supplied from the external apparatus. Thus, an electrostatic latent image according to the image information is formed on the charging surface of the photosensitive drum 1. The developing device 5 develops the electrostatic latent image with the yellow toner (developer). A toner image (developed image) is thus formed on the surface of the photosensitive drum 1.

Similarly, the above-described charging, exposure, and development processes are performed at the magenta (second color) image forming station SM, the cyan (third color) image forming station SC, and the black (fourth color) image forming station SK. As a result, toner images (developed images) of respective colors are formed on the surfaces of the photosensitive drums 1 of the image forming stations SY, SM, SC, and SK.

A paper feeding roller 4 feeds the recording material P from a paper feeding cassette 7, which has a storage capacity of a predetermined number of recording sheets. A positive bias is applied to an attraction roller 6, which charges the recording material P. The charged recording material P is electrostatically attracted and held on the outer circumferential surface of the recording material conveyance belt 9. The recording material P is successively conveyed from the transfer portion positioned on the upstream side of the recording material conveyance belt 9 to the transfer portion positioned on the downstream side of the recording material conveyance belt 9, while the recording material conveyance belt 9 travels at the predetermined speed corresponding to the process speed of the photosensitive drum 1.

A transfer bias having a predetermined polarity, which is opposite to that of the toner image, is applied to the transfer roller 10 of each of the image forming stations SY, SM, SC, and SK in the process of conveying the recording material P. The transfer bias applied on each transfer roller 10 causes the toner images on the corresponding surfaces of the photosensitive drums 1 of respective image forming stations SY, SM, SC, and SK to successively transfer to the surface of the recording material P. Thus, the recording material P can carry an unfixed full-color toner image on its surface, which results when all of the toner images are successively overlaid on the recording material P.

The recording material conveyance belt 9 conveys the recording material P carrying the unfixed full-color toner image to a heating fixing apparatus (fixing device) 100. When the recording material P passes through a nip portion N2 of the fixing apparatus 100, the fixing apparatus 100 thermally fixes the unfixed toner image on the recording material P. Discharge rollers 11 receive the recording material P carrying the toner image fixed thereon and discharge the recording material P to a discharge tray 13.

The drum cleaner 8 removes toner particles from the surface of the photosensitive drum 1 and recovers the removed toner particles, when the toner particles remain on the surface of the photosensitive drum 1 without being used for formation of the toner image.

In the following description for the fixing apparatus and its constituent member, the longitudinal direction is the direction perpendicular to a conveyance direction of the recording material and the widthwise direction is the direction parallel to the conveyance direction of the recording material. The length is defined as a size in the longitudinal direction. The width is a size in the widthwise direction.

Figure 2:
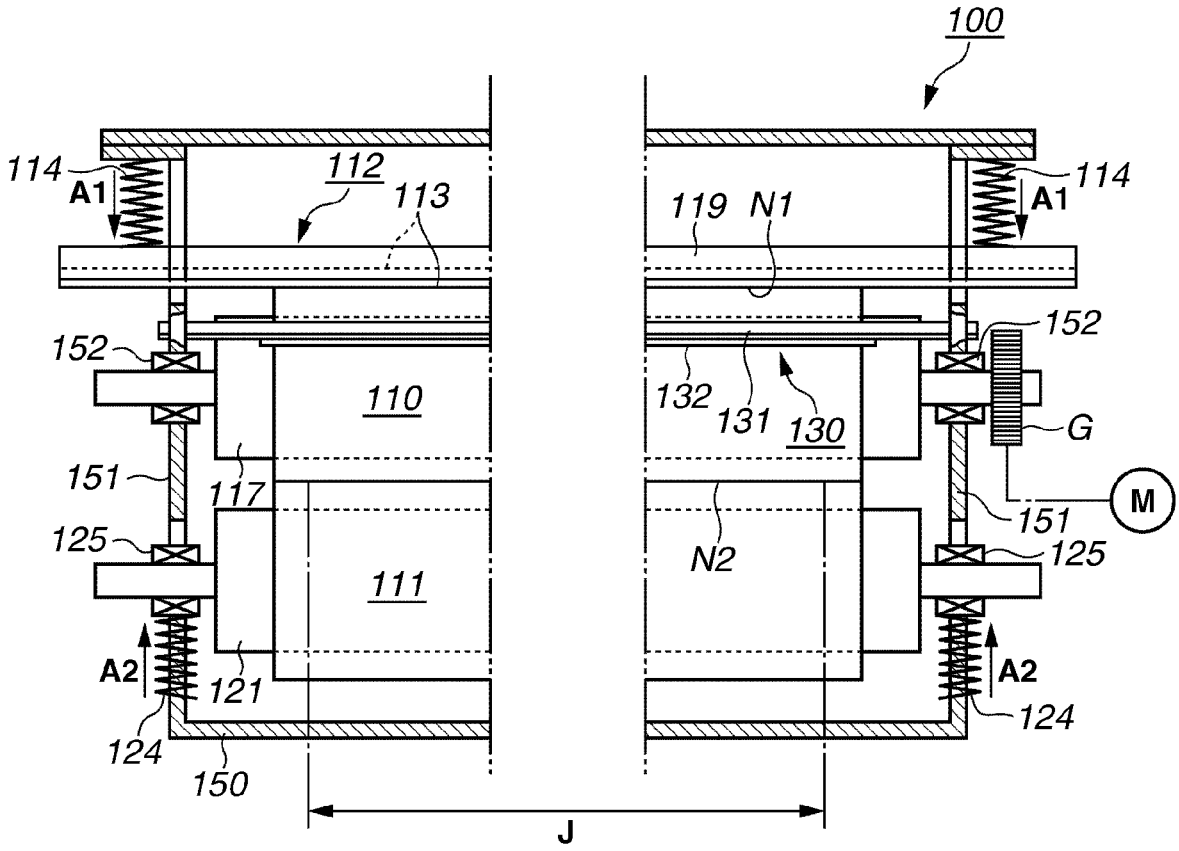
FIG. 2 is a front view illustrating the fixing apparatus according to the first exemplary embodiment, although its central portion in the longitudinal direction is partly omitted.

FIG. 1 is a cross-sectional view illustrating a main portion of the fixing apparatus 100. FIG. 2 is a front view illustrating the fixing apparatus 100, although its central portion in the longitudinal direction is partly omitted. The fixing apparatus 100 is an external heating type fixing apparatus. More specifically, the fixing apparatus 100 is a sliding contact-type fixing apparatus including a heating member, which is brought into contact with the surface of a fixing roller and can slide.

The fixing apparatus 100 according to the present exemplary embodiment includes a fixing roller 110 operable as a rotatable heating member, a heater unit 112, a pressing roller 111 operable as a back-up member, and a cleaning member 130. The pressing roller 111 has an outer circumferential surface that can form a nip portion (heating nip portion) N2 when it is brought into contact with an outer circumferential surface of the fixing roller 110. The heater unit 112 includes a heater 113 serving as a contact-sliding member. The heater 113 contacts the surface of the fixing roller 110 at a position different from the nip portion N2 in the rotational direction of the fixing roller 110. The heater 113 forms a contact-sliding portion (contact area) N1 having a length longer than a contact area of the recording material P having a maximum size that the apparatus can use in the generatrix direction of the fixing roller 110.

The cleaning member 130 is a member capable of cleaning the surface of the fixing roller 110. The cleaning member 130 is positioned on the downstream side of the contact-sliding portion N1 and on the upstream side of the nip portion N2 in the rotational direction of the fixing roller 110. Each of the fixing roller 110, the heater 113, the pressing roller 111, and the cleaning member 130 is a thin member extending in the longitudinal direction. The heater 113 serving as the contact-sliding member has a non-movable contact surface that contacts the surface of the fixing roller 110.

The fixing roller 110 includes an iron cored bar 117 having a diameter of ϕ12 mm and an elastic layer (a foamed rubber layer) 116 provided on the outer circumferential surface of the cored bar 117. The elastic layer 116 has a thickness of 4 mm and is made of a foamed silicone rubber.

If the fixing roller 110 has large values in heat capacity and heat conductivity, the heat smoothly enters from the outer surface of the fixing roller 110 and is absorbed by the internal member of the fixing roller 110. The surface temperature does not increase so efficiently. In other words, an insulating member having lower values in heat capacity and heat conductivity can reduce the rise time required to increase the temperature of the surface of the fixing roller 110.

The heat conductivity of the foamed rubber layer 116 is in the range of 0.11 to 0.16 W/m·K, which is lower than the heat conductivity of a solid rubber (approximately 0.25 to 0.29 W/m·K). The specific gravity of the foamed rubber 116 is approximately 0.75 to 0.85, which is lower than the specific gravity of the solid rubber (approximately 1.05 to 1.30). The specific gravity is relevant to the heat capacity. Therefore, the foamed rubber 116 has a low heat capacity. Accordingly, the foamed rubber 116 can reduce the rise time required to increase the temperature of the surface of the fixing roller 110. When the fixing roller 110 has a small outer diameter, the fixing roller 110 has a smaller heat capacity. However, if the outer diameter of the fixing roller 110 is excessively small, the width of the contact-sliding portion N1 becomes narrower. In the present exemplary embodiment, the fixing roller 110 has an outer diameter of ϕ20 mm as an appropriate diameter.

If the thickness of the elastic layer 116 is excessively thin, the heat leaks to the metallic cored bar 117. In the present exemplary embodiment, the elastic layer 116 has a thickness of 4 mm as an appropriate thickness.

A releasing layer 118, which is made of a perfluoroalkoxy resin (PFA) and serves as a toner releasing layer, is formed on an outer circumferential surface of the elastic layer 116. The releasing layer 118 is a coated tube or can be a paint layer coated on the surface of the elastic layer 116. In the present exemplary embodiment, the releasing layer 118 is made of a tube having an excellent durability. The material usable for the releasing layer 118 is not limited to the PFA and can be selected from fluorine resins, such as a polytetrafluorethylene resin (PTFE), a tetrafluorethylene-hexafluoropropylene resin (FEP), etc., and fluorine rubbers and silicone rubbers having good separation properties.

If the surface hardness of the fixing roller 110 is low, the contact-sliding portion N1 having a sufficient width can be easily obtained even if the applied pressure is low. However, if the surface hardness of the fixing roller 110 is excessively low, the durability of the fixing roller 110 becomes insufficient. In the present exemplary embodiment, the fixing roller 110 has a surface hardness of 40 to 45° in the Asker-C hardness (at the load of 4.9 N).

The cored bar 117 of the fixing roller 110 has an elongated body extending in the longitudinal direction and supported at both ends thereof by a pair of side plates 151 of an apparatus frame 150 via bearings 152 as to be rotatable. A fixing motor M (a driving unit) drives a driving gear G provided on one end of the cored bar 117 in the longitudinal direction. As a result, the fixing roller 110 rotates in the direction indicated by an arrow R2 with a surficial moving speed of 60 mm/sec.

To suppress heat transfer from the fixing roller 110 to the pressing roller 111, it is desired that the material for the pressing roller 111 has lower values in both heat capacity and heat conductivity. In the present exemplary embodiment, the pressing roller 111 is made of a material similar to that of the fixing roller 110.

The pressing roller 111 has an outer diameter of ϕ20 mm. The pressing roller 111 includes an iron cored bar 121 having a diameter of ϕ12 mm and an elastic layer 122 provided on the outer circumferential surface of the cored bar 121. The elastic layer 122 is a foamed rubber layer having a thickness of 4 mm. A releasing layer 123 (e.g., a PFA-made layer), serving as an outermost layer, is provided on the outer circumferential surface of the elastic layer 122.

The pressing roller 111 is positioned below the fixing roller 110 and is disposed in parallel with the fixing roller 110. The cored bar 121 has an elongated body extending in the longitudinal direction and supported at both ends thereof by the side plates 151 of the apparatus frame 150 via the bearings 125 to as to be rotatable. A pair of pressing springs 124, pressing the bearings 125 in an upward direction A2, applies a predetermined pressing force to the pressing roller 111. Thus, the surface of the pressing roller 111 contacts the surface of the fixing roller 110.

The pressing force of the pressing springs 124 causes the elastic layer 122 of the pressing roller 111 and the elastic layer 116 of the fixing roller 110 to elastically deform to form a nip portion (a fixing nip portion (a heating nip portion)) N2 having a predetermined width between the surface of the pressing roller 111 and the surface of the fixing roller 110. In the present exemplary embodiment, the pressing force applied from the pressing springs 124 to the bearings 125 is 147 N and the nip portion N2 having a width of 7 mm is formed.

Figure 3:
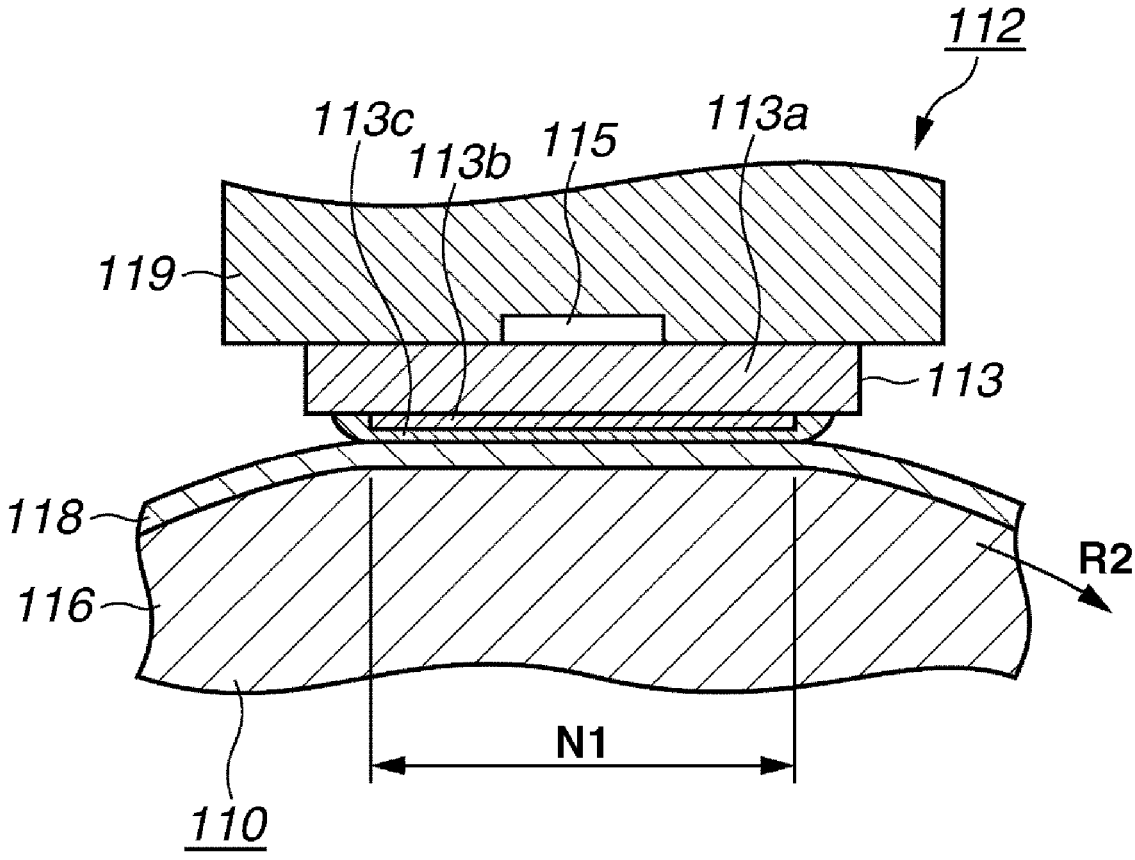
FIG. 3 is an enlarged cross-sectional view illustrating a contact-sliding portion and its vicinity of the fixing apparatus according to the first exemplary embodiment.
Figure 4:
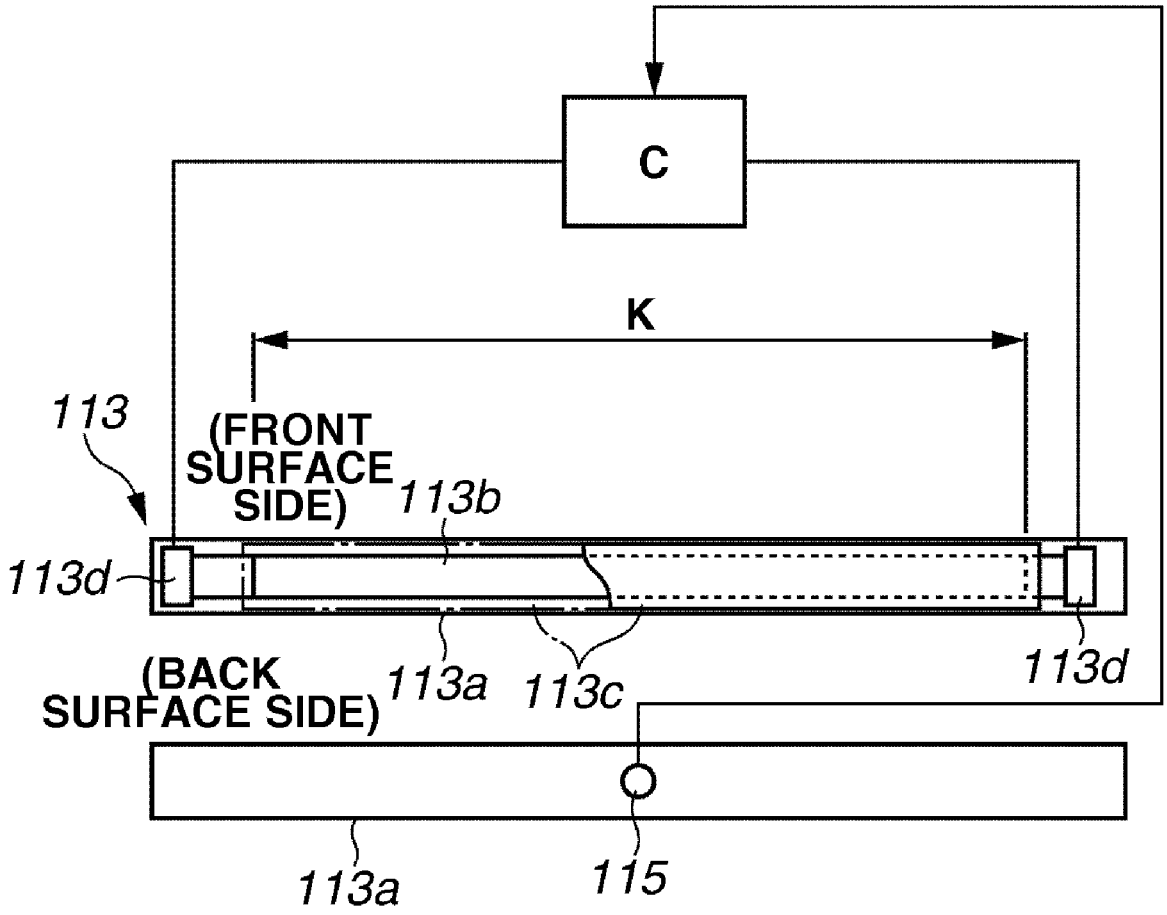
FIG. 4 illustrates an example heater.

FIG. 3 is an enlarged cross-sectional view illustrating the contact-sliding portion N1 and its vicinity of the fixing apparatus 100. FIG. 4 illustrates an example heater.

In the heater unit 112, the heater 113 is held by a heater holder 119. The heater holder 119 has an elongated body extending in the longitudinal direction and held at both ends thereof by the pair of side plates 151. A pair of pressing springs 114, generating the pressing force acting in a downward direction A1, presses the longitudinal ends of the heater holder 119 to bring the lower surface of the heater 113 into contact with the surface of the fixing roller 110. The pressing force of the pressing spring 114 elastically deforms the elastic layer 116 of the fixing roller 110. As a result, the contact-sliding portion N1 having a predetermined width is formed between the surface of the heater 113 and the surface of the fixing roller 110. In the present exemplary embodiment, the pressing force applied from the pressing spring 114 to the longitudinal ends of the heater holder 119 is set to 98 N. The contact-sliding portion (contact area) N1 having a width of 5.5 mm is formed.

Figure 15:
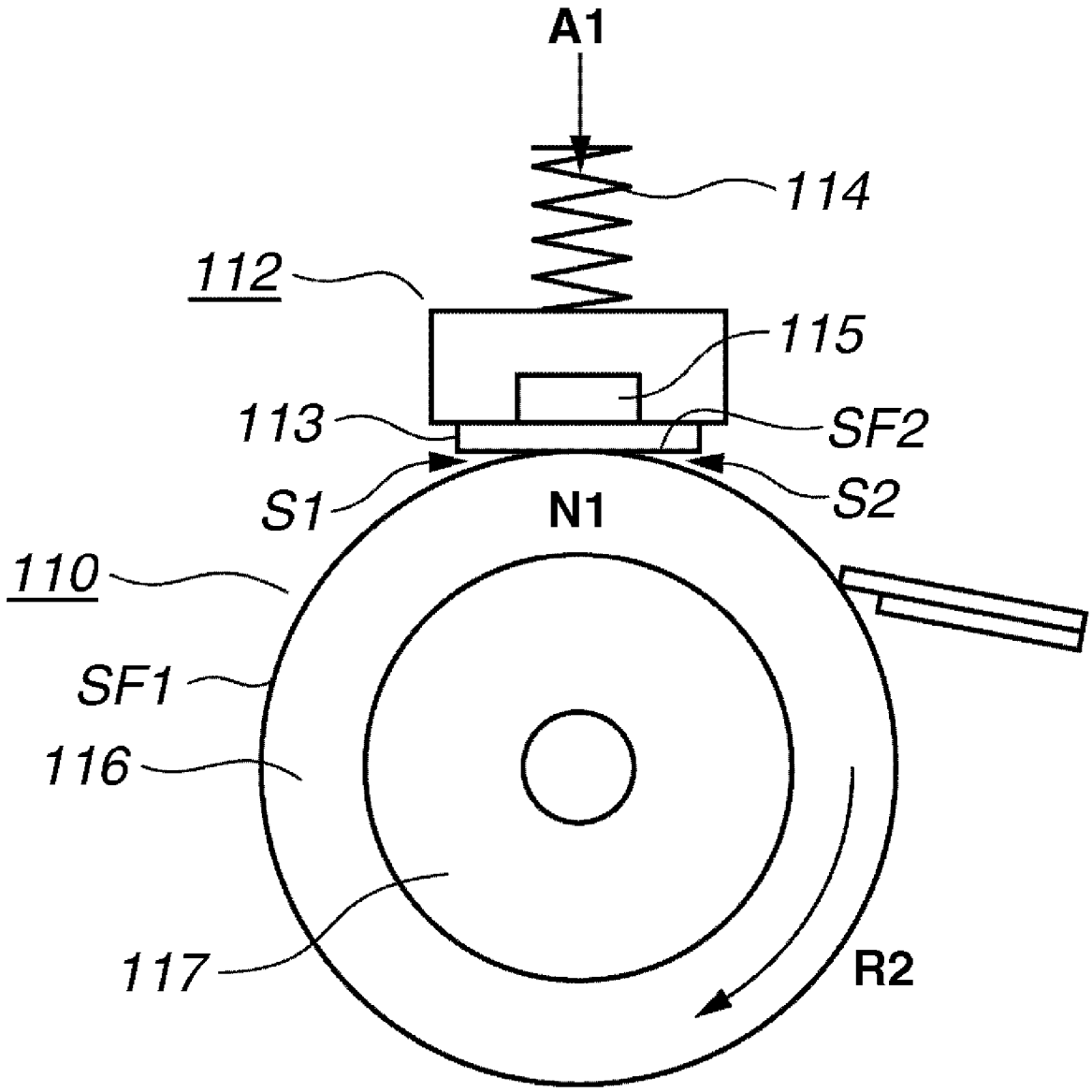
FIG. 15 is an enlarged view illustrating the contact-sliding portion and its vicinity illustrated in FIG. 1.

FIG. 15 is an enlarged view of the fixing roller 110 and the heater unit 112 illustrated in FIG. 1. As illustrated in FIG. 15, an inlet space S1 is formed between a fixing roller surface SF1 and a contact surface SF2 of the heater 113 on the upstream side of the contact area N1 between the fixing roller surface SF1 and the heater (contact-sliding member) 113 in the rotational direction of the fixing roller 110. An outlet space S2 is formed between the fixing roller surface SF1 and the contact surface SF2 of the heater 113 on the downstream side of the contact area N1 in the rotational direction of the fixing roller 110.

The heater 113 includes an alumina substrate 113*a* having a width of 6 mm and a thickness of 1 mm. A silver palladium (Ag/Pd) electric heat-generating layer 113*b*, having a thickness of 10 μm, is coated on a surface of the substrate 113*a*, which faces the surface of the fixing roller 110, along the longitudinal direction of the substrate 113*a*, by screen printing. The electric heat-generating layer (hereinafter, referred to as "heat-generating layer") 113*b* is covered with a glass layer to have a thickness of 50 μm, which serves as a heater protecting layer 113*c* formed on the heat-generating layer 113*b*. In the present exemplary embodiment, to efficiently transfer heat from the heater 113 to the fixing roller 110, the heater protecting layer 113*c* of the heater 113 is directly brought into contact with the surface of the fixing roller 110 to heat the surface of the fixing roller 110.

To reduce the frictional force acting between the surface of the heater 113 (the surface of the heater protecting layer 113*c*) and the surface of the fixing roller 110 at the contact-sliding portion N1, it is desired to provide a sliding layer (not illustrated) on the surface of the heater protecting layer 113*c* of the heater 113. A fluorine resin excellent in sliding properties, such as PTFE or PFA, can be used as a material for the sliding layer. If the provided sliding layer is excessively thick, the heat from the heater 113 cannot be smoothly transferred to the fixing roller 110. If the sliding layer is excessively thin, the sliding layer cannot possess a satisfactory durability. It is, therefore, desired that the thickness of the sliding layer be in the range of 1 to 100 μm. To reduce the contact heat resistance between the sliding layer and the heater 113, a fluorine resin layer can be directly coated on the heater 113. Alternatively, the sliding layer can be a sheet-like member excellent in both durability and surface properties.

A temperature detection element 115 is disposed on a back surface of the substrate 113*a* in an opposed relationship with the heater holder 119. The temperature detection element 115 can detect the temperature of the heater 113, which rises according to the heat generated by the heat-generating layer 113*b*. In response to an output signal from the temperature detection element 115, a temperature control unit C appropriately controls the current flowing through the power supply electrodes 113*d* to the heat-generating layer 113*b*. The power supply electrodes 113*d* are continuous from the heat-generating layer 113*b* and provided on the inner side of the substrate 113*a* at both ends thereof in the longitudinal direction. Thus, the temperature control unit C can adjust the temperature of the heater 113 to a predetermined fixing temperature (target temperature).

A drive control unit (not illustrated) drives the fixing motor M, which rotates the driving gear G, according to the print signal. Therefore, the fixing roller 110 rotates in the direction indicated by the arrow R2 at a surficial moving speed of 60 mm/sec. In this case, the rotational force acts on the pressing roller 111 due to the frictional force at the nip portion N2 between the surface of the fixing roller 110 and the surface of the pressing roller 111. The pressing roller 111 rotates in a direction opposite the rotational direction of the fixing roller 110. Thus, the pressing roller 111 is driven to rotate in the direction indicated by an arrow R3 at a surficial moving speed similar to that of the fixing roller 110 (see FIG. 1).

The temperature control unit C adjusts the current flowing through the power supply electrodes 113*d* of the heater 113 according to the print signal. The heat-generating layer 113*b* generates heat according to the current supplied. The heater 113 can speedily increase the temperature to heat the surface of the fixing roller 110. The heat-generating layer 113*b* has a length K (see FIG. 4) along the generatrix of the fixing roller 110, which is slightly longer than the maximum sheet-passing width J (FIG. 2) of the maximum recording material P that can be processed by the apparatus.

The temperature detection element 115 detects the temperature of the heater 113 and outputs a detection signal. The temperature control unit C receives the detection signal from the temperature detection element 115 and controls the current flowing through the power supply electrodes 113*d* based on the received detection signal so that the temperature of the heater 113 can be maintained at the predetermined fixing temperature. Therefore, the temperature of the heater 113 is maintained at the predetermined fixing temperature. The heater 113 heats the surface of the fixing roller 110 via the contact-sliding portion N1.

In a state where the fixing roller 110 and the pressing roller 111 are stably rotating and the temperature of the heater 113 is maintained at the predetermined fixing temperature, a recording material carrying an unfixed color toner image (hereinafter, referred to as "unfixed toner image") T reaches the nip portion N2 along a conveyance direction A3. The recording material P is held at the nip portion N2 between the surface of the fixing roller 110 and the surface of the pressing roller 111 and is conveyed in the conveyance direction A3. In the conveyance process, the recording material P receives the heat from the surface of the fixing roller 110, which is heated by the heater 113, and receives the pressure at the nip portion N2. In this manner, the thermal fixation of the toner image T on the recording material P can be realized under the provision of the heat and the pressure.

The cleaning member 130 includes a cleaning blade 131 and a blade holding metal plate 132 holding the cleaning blade 131.

The cleaning blade 131 has a blade tip portion 131*a* brought into contact with the surface of the fixing roller 110 in a counter fashion, as seen from the rotational direction R2 of the fixing roller 110, to efficiently scrape the dirt off the surface of the fixing roller 110. In the present exemplary embodiment, it is desired that the cleaning blade 131 of the cleaning member 130 be made of a soft resin material rather than a hard metallic member, because the soft resin material does not damage the surface of the fixing roller 110. It is further desired that the cleaning blade 131 have excellent heat-resisting properties against the heat from the surface of the fixing roller 110.

In the present exemplary embodiment, the cleaning blade 131 is made of a polyimide resin material excellent in both heat-resisting properties and strength. The polyimide resin-made cleaning blade 131 is disposed on the blade holding metal plate 132 made of a SUS material. The length of the cleaning blade 131 is substantially equal to or longer than the length of the fixing roller 110. If the thickness of the blade tip portion 131*a* of the cleaning blade 131 is thin, the blade tip portion 131*a* can easily scrape the dirt. However, if the thickness of the blade tip portion 131*a* is excessively thin, the strength of the tip portion 131*a* becomes insufficient. Therefore, it is desired that the thickness of the blade tip portion 131*a* be in the range of 20 μm to 200 μm. In the present exemplary embodiment, the thickness of the blade tip portion 131*a* is set to 100 μm.

A contact angle θ of the blade tip portion 131*a* represents an angle between the blade tip portion 131*a* and a tangential line of the fixing roller 110 at the portion where the blade tip portion 131*a* contacts the surface of the fixing roller 110 (an angle on the downstream side of the contact point of the blade tip portion 131*a* in the rotational direction R2 of the fixing roller 110). As the blade tip portion 131*a* contacts the surface of the fixing roller 110 at its front edge, the contact angle of the blade tip portion 131*a* is in the range of 0° to 180° that theoretically enables the cleaning blade 131 to scrape the dirt off the surface of the fixing roller 110. However, to effectively scrape the dirt, it is desired that the contact angle be in the range of 0° to 90° so that the cleaning blade 131 is bought into contact with the surface of the fixing roller 110 in the counter fashion, as seen from the rotational direction R2 of the fixing roller 110. In the present exemplary embodiment, the contact angle of the blade tip portion 131 is set to 40°.

When the blade tip portion 131*a* contacts the surface of the fixing roller 110 at the above-described contact angle (40°), the cleaning blade 131 can efficiently scrape the dirt off the surface of the fixing roller 110. Additionally, when a contact pressure of the blade tip portion 131*a* is high, the cleaning blade 131 can efficiently scrape the dirt off the surface of the fixing roller 110. However, if the contact pressure of the blade tip portion 131*a* is excessively high, the blade tip portion 131*a* may damage or abrade the surface of the fixing roller 110. Therefore, it is desired that the contact pressure (linear pressure) of the blade tip portion 131*a* be in the range of 10 to 500 mN/cm. In the present exemplary embodiment, the contact pressure of the blade tip portion 131*a* is set to 49 mN/cm.

Figure 5:
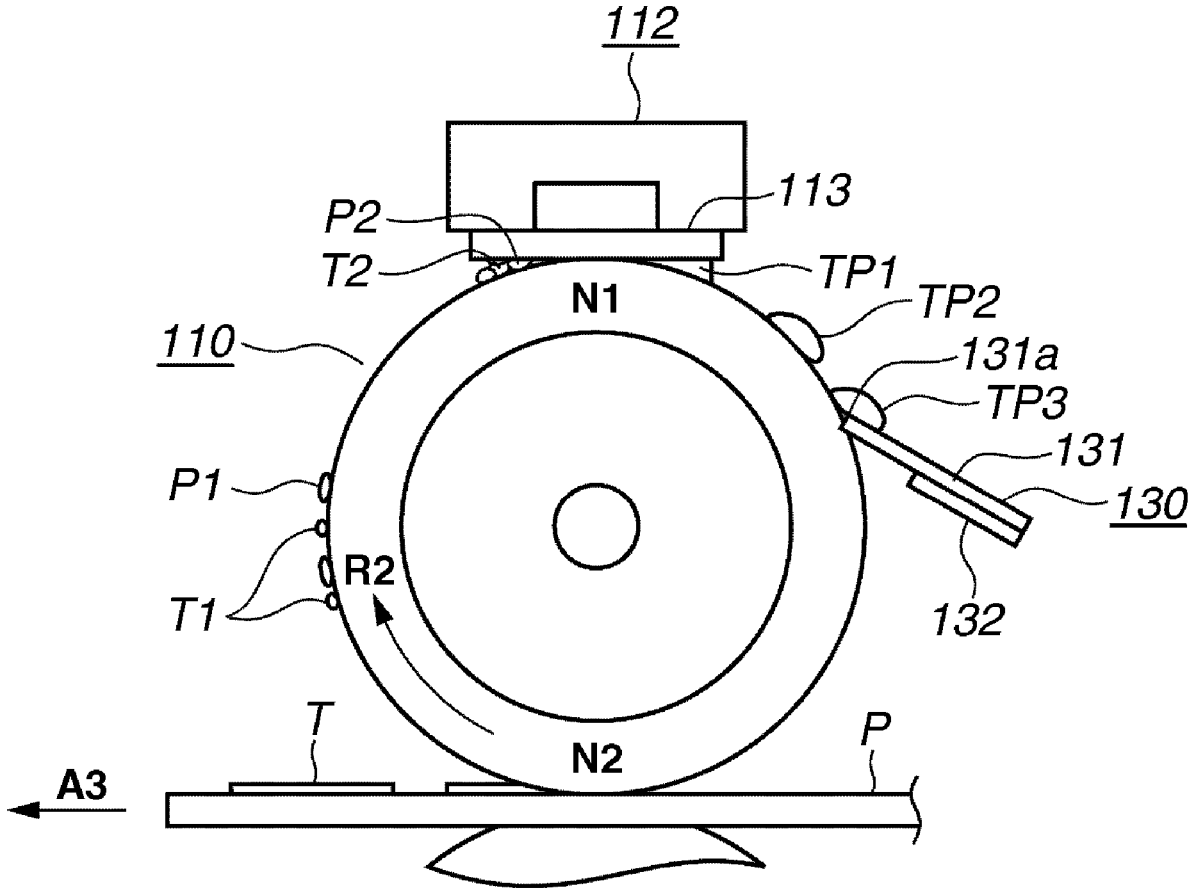
FIG. 5 illustrates a cleaning blade of the fixing apparatus in the process of cleaning the surface of a fixing roller according to the first exemplary embodiment.

An example process of cleaning the surface of the fixing roller 110, which can be performed by the fixing apparatus 100 according to the present exemplary embodiment, is described below with reference to FIG. 5. FIG. 5 illustrates the cleaning blade 131 of the fixing apparatus 100 in the process of cleaning the surface of the fixing roller 110 according to the present exemplary embodiment.

When a recording material (e.g., recording paper) P carrying an unfixed toner image T passes through the nip portion N2, a small amount of dirt (e.g., offset toner T1 and paper dust P1) adheres to the surface of the fixing roller 110. The offset toner T1 and the paper dust P1 on the surface of the fixing roller 110 reach the contact-sliding portion N1 (see T2 and P2 in FIG. 5) because the fixing roller 110 rotates in the direction indicated by the arrow R2. The heater 113 forming the contact-sliding portion N1 has the contact surface SF2 that contacts the surface SF1 of the fixing roller 110. Therefore, the inlet space S1 (a portion in an opened state) is positioned on the upstream side of the contact-sliding portion N1 in the rotational direction R2 of the fixing roller 110. Therefore, compared to the arrangement using the blade having a front edge contacting the fixing roller, it is difficult to surely remove the paper dust P2 at the inlet side of the contact-sliding portion N1. The offset toner T2 and the paper dust P2 having reached the contact-sliding portion N1 gradually enter the contact-sliding portion N1. The offset toner T2 and the paper dust P2, having entered the contact-sliding portion N1, receive the heat from the heater 113 and are mixed together.

The offset toner T2, which melts at least partly by the heat from the heater 113, permeates the paper dust P2, while it passes through the contact-sliding portion N1. The dirt of the paper dust P2 containing the melted offset toner T2 basically adheres to the surface SF2 of the heater 113. However, due to a significant amount of force acting from the surface SF1 of the fixing roller 110 moving in the rotational direction R2, the dirt on the surface SF2 of the heater 113 gradually moves to the downstream side of the contact-sliding portion N1 in the rotational direction R2 of the fixing roller 110.

The dirt of the paper dust P2 containing the melted offset toner T2, after passing through the contact-sliding portion N1, accumulates in the outlet space S2 positioned on the downstream side of the contact-sliding portion N1 (see TP1 illustrated in FIG. 5). When the number of printed sheets increases, the amount of the paper dust dirt TP1 remaining in the outlet space S2 increases and the size of the paper dust dirt TP1 increases correspondingly. If the contact area of the paper dust dirt TP1 having grown and the surface SF1 of the fixing roller 110 exceeds a predetermined value, the paper dust dirt TP1 may be transferred to the surface of the fixing roller 110 (see TP2 in FIG. 5).

However, the fixing apparatus 100 according to the present exemplary embodiment includes the cleaning blade 130 provided on the downstream side of the contact-sliding portion N1 and on the upstream side of the nip portion N2 in the rotational direction of the fixing roller 110 (the direction indicated by the arrow R2). Therefore, the blade tip portion 131*a* of the cleaning blade 130 scrapes and removes the paper dust dirt TP2 from the surface of the fixing roller 110 in the intermediate region between the contact-sliding portion N1 and the nip portion N2 (see TP3 in FIG. 5). The paper dust dirt TP3 having been removed by the blade tip portion 131*a* is collected by a collecting container (not illustrated) provided on the rear end side of the cleaning blade 130.

The offset toner T2 permeates the paper dust P2 in the process of passing through the contact-sliding portion N1 and becomes part of the paper dust dirt TP2. Therefore, compared to the offset toner T2, the paper dust dirt TP2 has an extremely lower viscosity. In other words, compared to the removal of the offset toner T2, the cleaning blade 131 can easily remove the paper dust dirt TP2. The paper dust dirt TP2 to be scraped by the cleaning blade 130 becomes larger in volume in the process of accumulating (growing) in the outlet space S2. The paper dust dirt TP2 has a sufficiently large body size for the cleaning blade 130 to scrape, compared to the size of the offset toner T2 or the paper dust P2 before reaching the contact-sliding portion N1. The paper dust dirt TP3 having reached the cleaning blade 130 has a sufficiently large body that cannot easily pass through the blade tip portion 131*a*.

As the paper dust dirt TP3 has a small viscosity, the paper dust dirt TP3 can quickly move from the blade tip position to the collecting container after the paper dust dirt TP3 is removed by the blade tip portion 131*a*. Accordingly, after the paper dust dirt TP3 is collected in the collecting container by the cleaning blade 131, the paper dust dirt TP3 does not melt even when the blade tip portion 131*a* receives the heat from the surface of the fixing roller 110.

Therefore, the cleaning blade 131 can completely remove the dirt from the surface of the fixing roller 110. As a result, the recording material P is not soiled. As described above, the present exemplary embodiment causes the paper dust P2 and the toner T2 to grow into a large lump in the inlet space S1 provided on the upstream side of the contact area N1 and the outlet space S2 provided on the downstream side of the contact area N1. Therefore, the present exemplary embodiment can remove the lump of the dirt from the fixing roller surface after the dirt lump has sufficiently grown.

Figure 13:
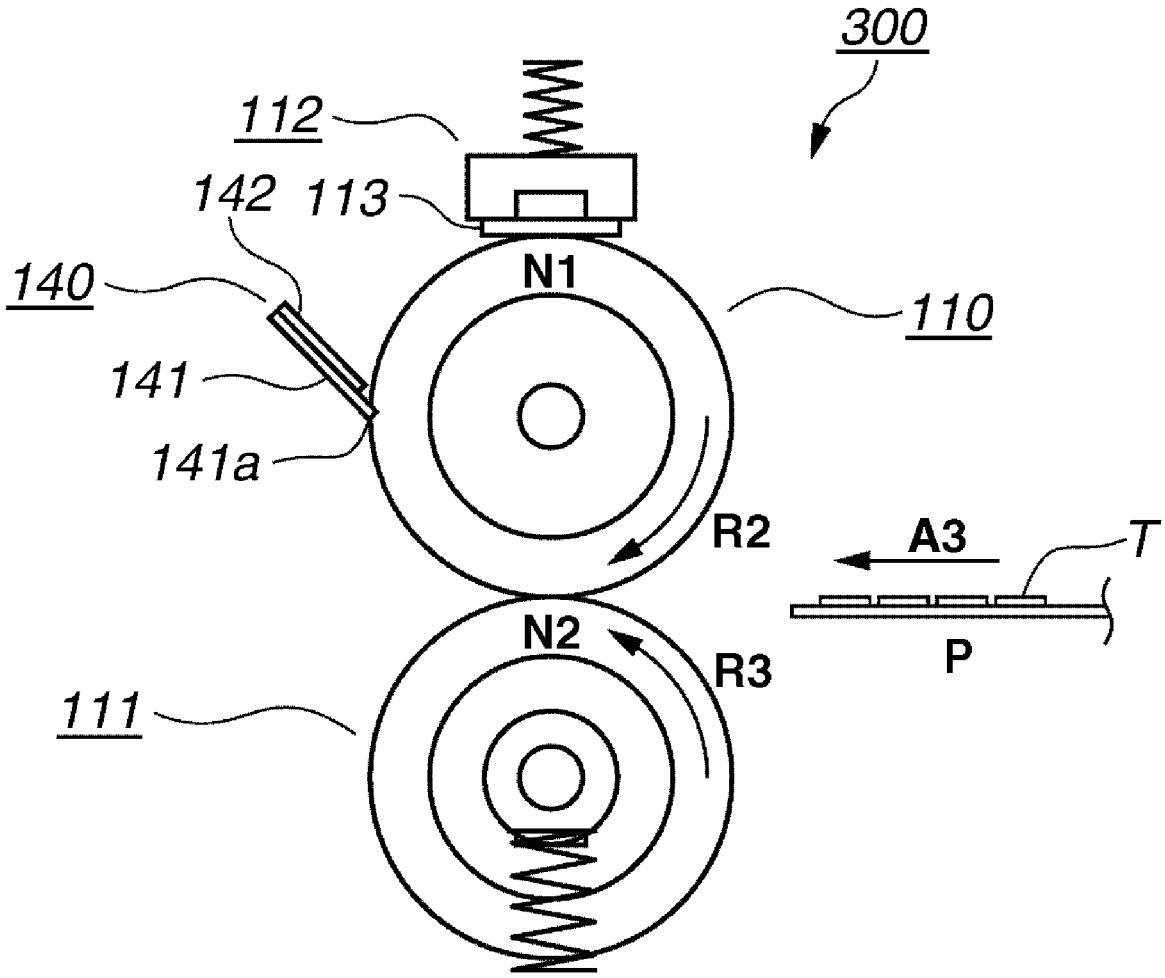
FIG. 13 is a cross-sectional view illustrating a main portion of a comparative fixing apparatus.

FIG. 13 is a cross-sectional view illustrating a main portion of a comparative fixing apparatus 300. The comparative fixing apparatus 300 is similar to the fixing apparatus 100 according to the present exemplary embodiment in configuration except that the cleaning member 130 is disposed at a different position. The comparative fixing apparatus 300 includes constituent members similar to those of the fixing apparatus 100 according to the present exemplary embodiment, which are, therefore, denoted using the same reference numerals.

The comparative fixing apparatus 300 includes a cleaning member 140 capable of cleaning the surface of the fixing roller 110, which is similar to the cleaning member 130 according to the present exemplary embodiment. The cleaning member 140 includes a cleaning blade 141 and a blade holding metal plate 142 holding the cleaning blade 141. The cleaning blade 141 is positioned on the upstream side of the contact-sliding portion N1 and on the downstream side of the nip portion N2 in the rotational direction R2 of the fixing roller 110. The cleaning blade 141 includes a blade tip portion 141*a* configured to contact the surface of the fixing roller 110 in a counter fashion in the rotational direction R2 of the fixing roller 110, to scrape the dirt off the surface of the fixing roller 110.

Figure 14:
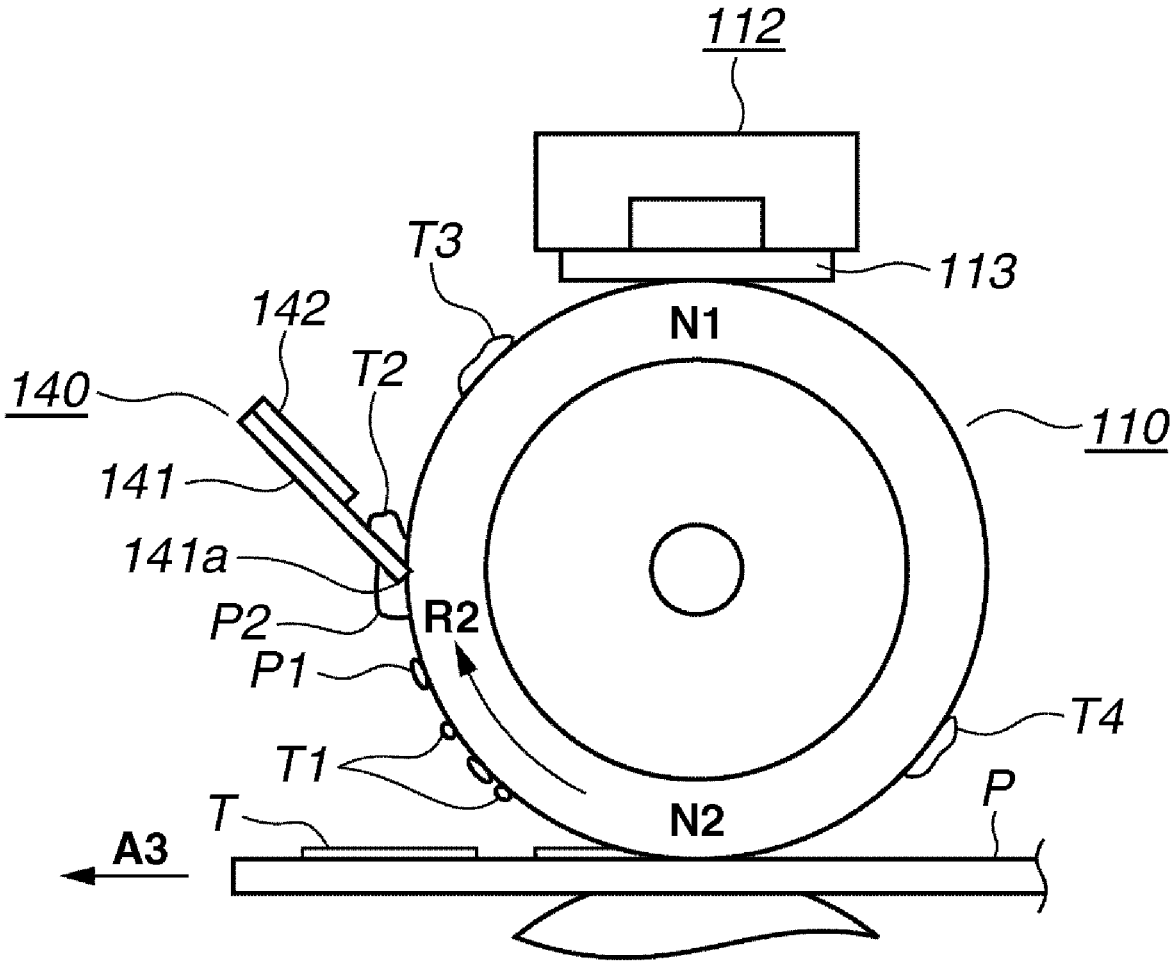
FIG. 14 illustrates a cleaning blade of the comparative fixing apparatus in the process of cleaning the surface of a fixing roller.

An example process of cleaning the surface of the fixing roller 110 of the comparative fixing apparatus 300 is described below with reference to FIG. 14. FIG. 14 illustrates the cleaning blade 141 of the comparative fixing apparatus 300 in the process of cleaning the surface of a fixing roller 110.

When a recording material (e.g., recording paper) P carrying an unfixed toner image T passes through the nip portion N2, a small amount of dirt (offset toner T1 and paper dust P1) adheres to the surface of the fixing roller 110. According to the structure illustrated in FIG. 14, the blade tip portion 141*a* of the cleaning blade 141 contacts the surface of the fixing roller 110 at its front edge. Therefore, there is no inlet space in the vicinity of the cleaning blade 141. The blade tip portion 141*a* of the cleaning blade 141 scrapes and removes the offset toner T1 and the paper dust P1 off the surface of the fixing roller 110.

In this case, the paper dust P1 does not melt by the heat from the surface of the fixing roller 110 and is, therefore, stopped by the blade tip portion 141*a*. As a result, a lump of the paper dust P1 is accumulated on the front surface of the cleaning blade 141 (see P2 in FIG. 14). On the other hand, the offset toner T1 melts by the heat from the surface of the fixing roller 110 and, therefore, can pass through the blade tip portion 141*a*. As a result, a lump of the offset toner T1 is accumulated on the back surface of the blade tip portion 141*a* (see T2 in FIG. 14).

If the accumulation amount of the offset toner T2 on the back surface of the blade tip portion 141*a* increases due to repeated printing, and if the contact area between the offset toner T2 and the surface of the fixing roller 110 is sufficiently large, the offset toner T2 may be discharged to the surface of the fixing roller 110 (see T3 in FIG. 14). The offset toner T3 discharged to the surface of the fixing roller 110 is in a melting state and, therefore, passes through the contact-sliding portion N1 (see T4 in FIG. 14) and may soil the surface of the recording material P.

A print durability test was conducted and its result was compared between the fixing apparatus 100 according to the present exemplary embodiment and the comparative fixing apparatus 300. The print durability test includes continuously printing an image having a printing rate of 5% and confirming the presence of any dirt on each recording paper by visual check.

In the comparative fixing apparatus 300, the offset toner adhering on the surface of the fixing roller 110 melts by the heat from the fixing roller 110. As a result, the offset toner passes through the blade tip portion 141*a* and the contact-sliding portion N1. Therefore, at the time when the number of printed sheets has reached 1,000, a very small amount of dirt was first confirmed on recording paper. After that, a similar dirt was confirmed once every 100 recording sheets. Further, at the time when the number of printed sheets exceeds 50,000, a relatively expanded dirt was confirmed on recording paper.

After that, a similar dirt was confirmed at two or more portions on recording paper once every 20 recording sheets.

On the other hand, in the fixing apparatus 100 according to the present exemplary embodiment, the contact-sliding portion N1 can adequately mix the offset toner with the paper dust adhering on the surface of the fixing roller 110 and let the mixed dirt grow into a larger lump in the outlet space. The cleaning blade 131 collects the enlarged lump of the dirt. Therefore, the present exemplary embodiment can prevent the dirt from being discharged (returned) from the cleaning blade 131 to the surface of the fixing roller 110. Thus, in the fixing apparatus 100 according to the present exemplary embodiment, no dirt was confirmed on each recording sheet until the number of printed sheets reaches 100,000 corresponding to the endurance life of the fixing apparatus 100.

In the comparative fixing apparatus 300, the offset toner dirt melting by the heat from the fixing roller 110 easily passes through the cleaning blade 141. Alternatively, in the case where the comparative fixing apparatus 300 does not include the contact-sliding member that contacts and slides along the surface of the fixing roller 110, the offset toner dirt melting by the heat from the fixing roller passes through the cleaning blade 141.

In the fixing apparatus 100 according to the present exemplary embodiment, the cleaning member 130 is not limited to the cleaning blade 131 and can be any member capable of removing the dirt off the surface of the fixing roller 110.

Figure 6:
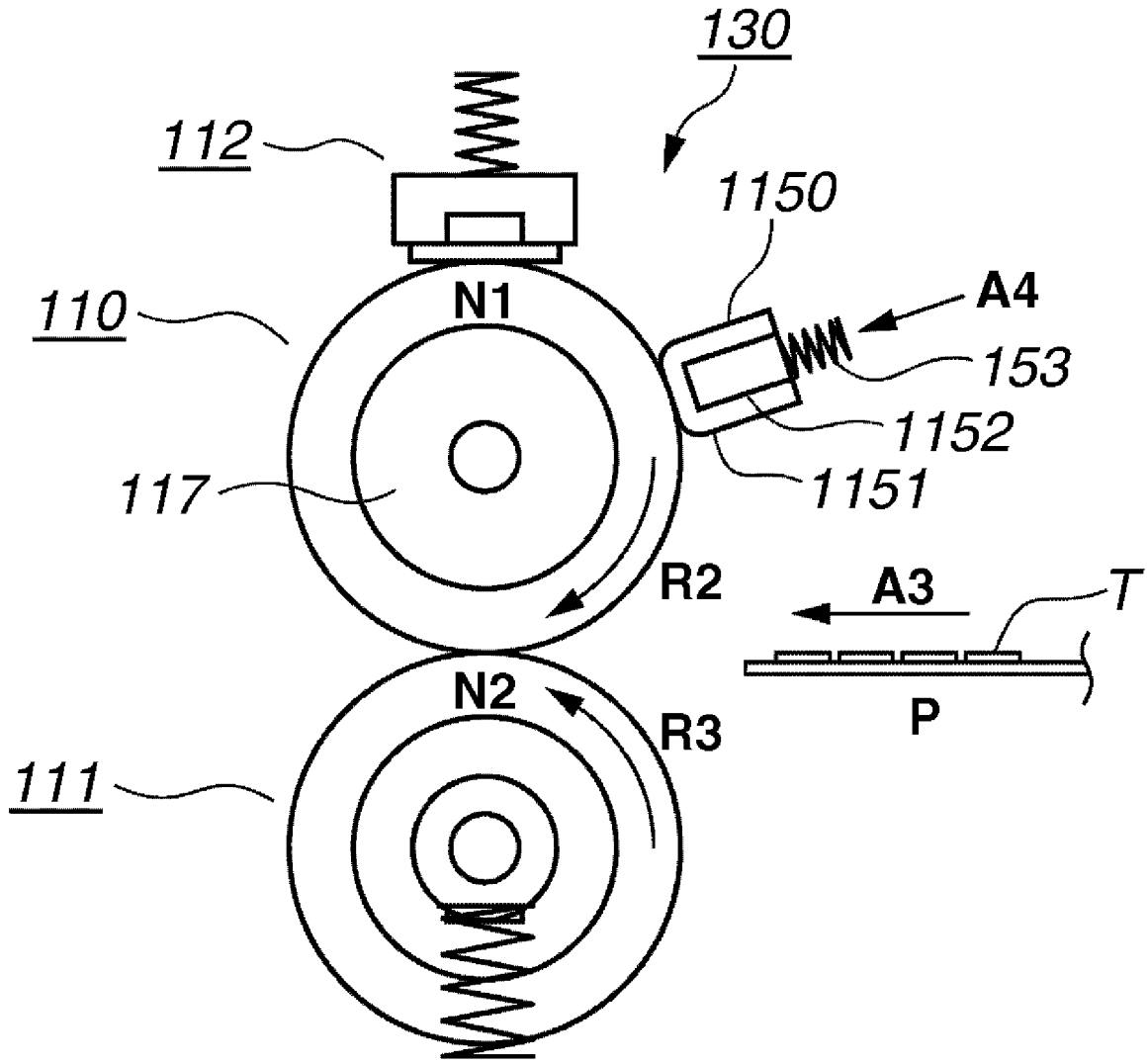
FIG. 6 is a cross-sectional view illustrating a main portion of another fixing apparatus according to the first exemplary embodiment, which uses a cleaning pad as an example cleaning member.

FIG. 6 is a cross-sectional view illustrating a main portion of the fixing apparatus 100, which uses a cleaning pad 1150 as an example of the cleaning member 130.

The cleaning pad 1150 includes a pad holding metal plate 1152 made of a SUS material and a nonwoven fabric pad 1151 made of an aramid member having a thickness of 1 mm and wound around the pad holding metal plate 1152. A pad pressing spring 153 presses the cleaning pad 1150 toward the center of the cored bar 117 of the fixing roller 110 along the direction indicated by an arrow A4. The pressing force of the pad pressing spring 153 brings the nonwoven fabric pad 1151 of the cleaning pad 1150 into contact with the surface of the fixing roller 110.

Compared to the arrangement using the cleaning blade 131 serving as the cleaning member 130, the fixing apparatus 100 using the cleaning pad 1150 serving as the cleaning member 130 can select a soft material for the cleaning member 130. Therefore, the fixing apparatus 100 using the cleaning pad 1150 serving as the cleaning member 130 does not damage the surface of the fixing roller 110. In the fixing apparatus 100, the contact-sliding portion N1 can adequately mix the offset toner with the paper dust adhering on the surface of the fixing roller 110 and let the mixed dirt grow into a larger lump in the outlet space. The nonwoven fabric pad 1151 collects the paper dust dirt containing the permeated offset toner from the surface of the fixing roller 110. Therefore, the present exemplary embodiment prevents the dirt from being discharged (returned) from the cleaning pad 1150 to the surface of the fixing roller 110.

Figure 7:
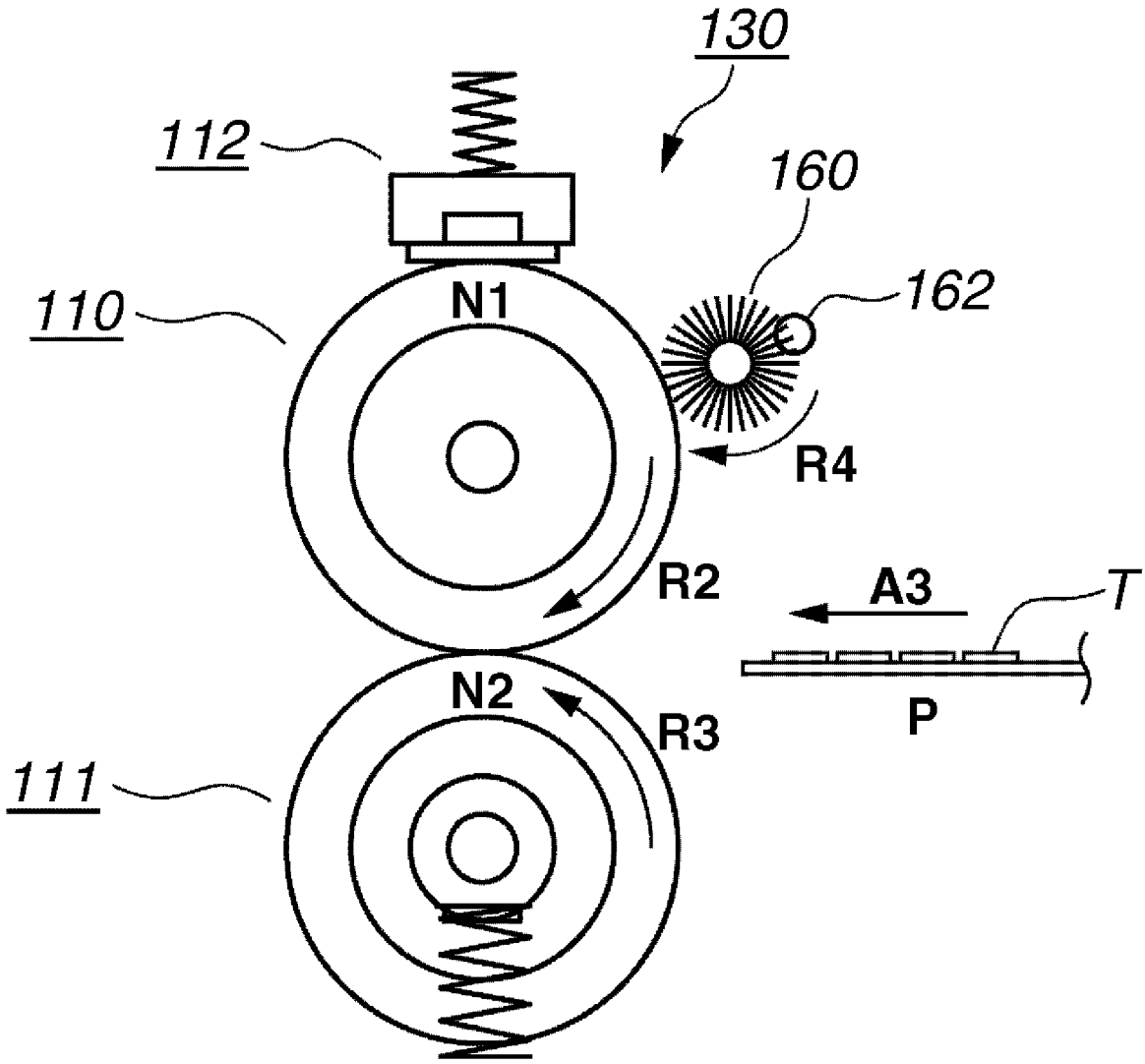
FIG. 7 is a cross-sectional view illustrating a main portion of another fixing apparatus according to the first exemplary embodiment, which uses a brush cleaning roller as an example cleaning member.

As illustrated in FIG. 7, a brush cleaning roller 160 can be used as the cleaning member 130.

FIG. 7 is a cross-sectional view illustrating a main portion of the fixing apparatus 100, which uses the brush cleaning roller 160 as an example of the cleaning member 130.

The cleaning roller 160 is made of a polyimide resin having excellent heat-resisting properties and is configured into a brush roll shape. The cleaning roller 160 rotates in the direction indicated by an arrow R4 (i.e., the counter direction) against the rotation of the fixing roller 110, while the brush of the cleaning roller 160 scrapes the dirt off the surface of the fixing roller 110. A flicker 162, made of a SUS material, shakes off the dirt scraped by the cleaning roller 160 from the cleaning roller 160.

The fixing apparatus 100 using the brush cleaning roller 160 serving as the cleaning member 130 can reduce the frictional resistance between the cleaning roller 160 and the fixing roller 110 and, therefore, can reduce the rotational torque of the fixing roller 110. In the fixing apparatus 100, the contact-sliding portion N1 can adequately mix the offset toner with the paper dust adhering on the surface of the fixing roller 110 and let the mixed dirt grow into a larger lump in the outlet space. The cleaning roller 160 collects the paper dust dirt containing the permeated offset toner from the surface of the fixing roller 110. Therefore, the present exemplary embodiment prevents the dirt from being discharged (returned) from the cleaning roller 160 to the surface of the fixing roller 110.

The fixing apparatus 100 according to the present exemplary embodiment provides the contact-sliding portion N1 formed by bringing the heater 113 into contact with the surface of the fixing roller 110 so as to provide the inlet space and the outlet space. The offset toner and the paper dust adhering on the surface of the fixing roller 110 can be adequately mixed with each other and grow into a large lump of the dirt. Therefore, the paper dust dirt can be easily removed from the surface of the fixing roller 110.

The cleaning member 130 is positioned on the downstream side of the contact-sliding portion N1 and on the upstream side of the nip portion N2 in the rotational direction of the fixing roller 110. The paper dust dirt can be surely removed from the surface of the fixing roller 110 before the paper dust dirt reaches the nip portion N2. Accordingly, the fixing apparatus 100 according to the present exemplary embodiment can prevent the dirt from remaining on the surface of the fixing roller 110, without complicating the structure of the fixing apparatus 100. The fixing apparatus 100 according to the present exemplary embodiment can prevent a defective image from being generated by the dirt of the surface of the fixing roller 110.

The fixing apparatus 100 according to the present exemplary embodiment causes the heater 113 to heat the fixing roller 110 via the contact surface thereof. The fixing apparatus 100 can reduce the rise time required to increase the surface temperature of the fixing roller 110 to the predetermined fixing temperature after starting power supply to the heater 113. Thus, the fixing apparatus 100 can reduce electric power consumption.

In the fixing apparatus 100 according to the present exemplary embodiment, the fixing roller 110 includes the elastic layer 116. Therefore, the heater 113 and the fixing roller 110 can hermetically contact with each other. The offset toner and the paper dust adhering on the surface of the fixing roller 110 can be effectively mixed at the contact-sliding portion N1. Therefore, the cleaning member 130 can surely remove the dirt mixture containing the paper dust and the offset toner off the surface of the fixing roller 110.

When the fixing apparatus 100 according to the present exemplary embodiment uses the cleaning blade 131 serving as the cleaning member 130 (i.e., the member capable of removing the dirt off the surface of the fixing roller 110), the cleaning blade 131 is simple in structure and can surely scrape the dirt off the surface of the fixing roller 110. When the fixing apparatus 100 according to the present exemplary embodiment uses the cleaning pad 1150 serving as the cleaning member 130, the cleaning pad 1150 can remove the dirt off the surface of the fixing roller 110 without damaging or abrading the surface of the fixing roller 110. Using the cleaning roller 160 serving as the cleaning member 130 is advantageous in that the frictional resistance between the cleaning roller 160 and the fixing roller 110 can be reduced and the rotational torque of the fixing roller 110 can be reduced.

A fixing apparatus according to a second exemplary embodiment of the present invention is an external heating type fixing apparatus, more specifically a movable contact-type fixing apparatus that includes a heating roller heated by a heating member and moving together with the fixing roller surface. In the present exemplary embodiment, constituent members common to those of the fixing apparatus 100 according to the first exemplary embodiment are denoted by the same reference numerals.

Figure 8:
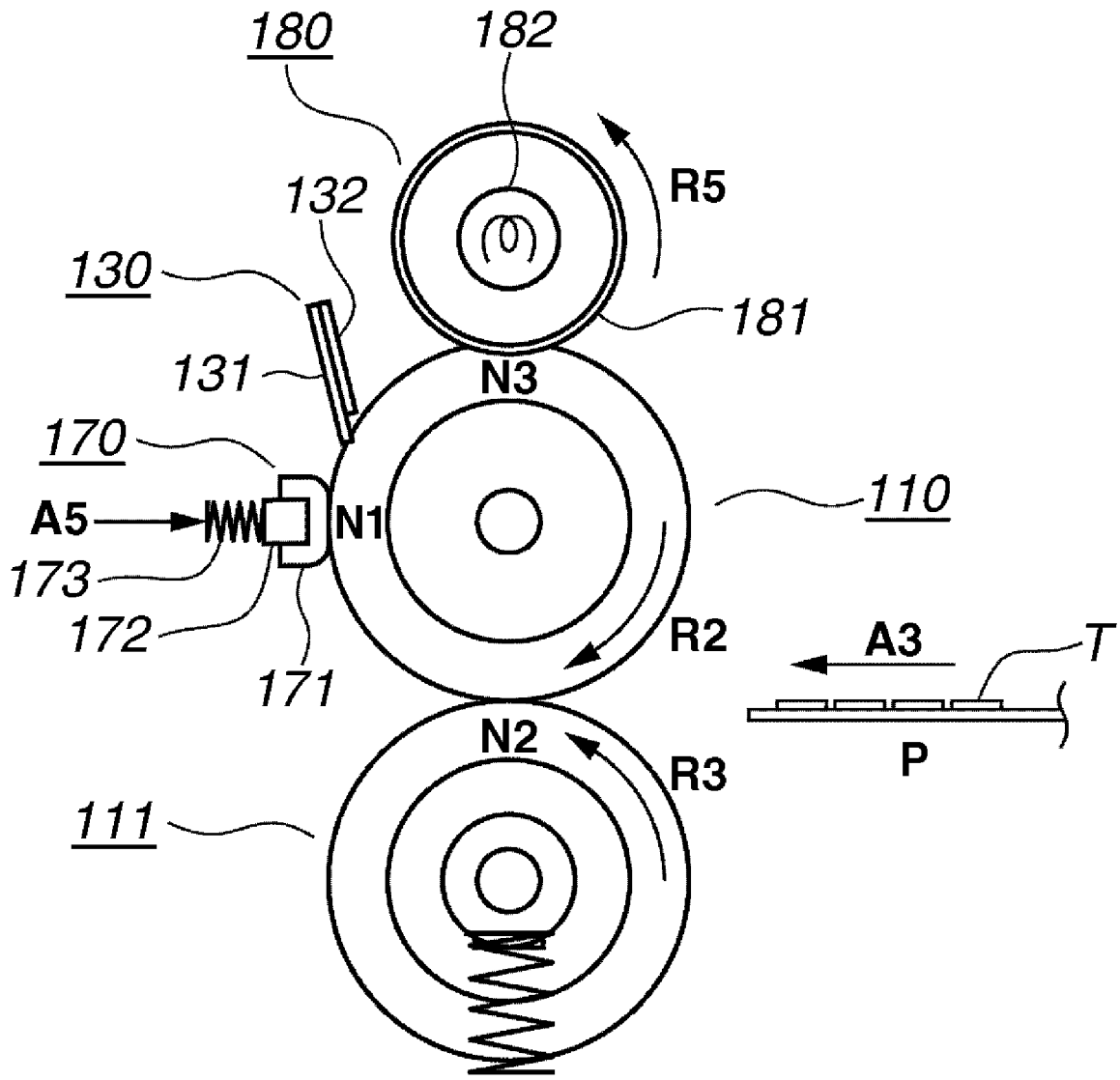
FIG. 8 is a cross-sectional view illustrating a main portion of a fixing apparatus according to a second exemplary embodiment of the present invention.

FIG. 8 is a cross-sectional view illustrating a main portion of the fixing apparatus 100 according to the exemplary embodiment.

The fixing apparatus 100 according to the present exemplary embodiment is similar to the fixing apparatus 100 according to the first exemplary embodiment, except that a heated roller 180 operable as a rotatable heating member is employed and that a contact-sliding member 170, the heated roller 180, and the cleaning member 130 are differently disposed.

In the fixing apparatus 100 according to the present exemplary embodiment, the heated roller 180 includes a halogen heater 182 and an aluminum cylindrical heating pipe 181 surrounding the halogen heater 182.

The halogen heater 182 has an elongated body extending in the longitudinal direction and held at both ends thereof by the pair of side plates 151 of the apparatus frame 150. The halogen heater 182, when electric power is supplied, generates radiation heat (radiation energy) and heats the heated roller 180 from the inside.

The heating pipe 181 has an elongated body extending in the longitudinal direction and held at both ends thereof by the pair of side plates 151 via bearings (not illustrated) so as to be rotatable. The heating pipe 181 has an outer circumferential surface, which contacts the surface of the fixing roller 110 to form a heating nip portion N3 having a predetermined width between the heating pipe 181 and the fixing roller 110. A radiant paint layer having a higher emissivity is coated on the internal cylindrical surface (inner surface) of the heating pipe 181, so that the radiation energy emitted from the halogen heater 182 can be effectively absorbed.

The outer surface of the heating pipe 181 is covered with a PFA coating layer having excellent separation properties, which can prevent dirt from adhering on the outer surface of the heating pipe 181. Accordingly, the heating pipe 181 heated by the halogen heater 182 is driven by the fixing roller 110 rotating in the direction indicated by the arrow R2 and, therefore, rotates in the direction indicated by an arrow R5. The heating pipe 181 heats the surface of the fixing roller 110 via the heating nip portion N3, while the heating pipe 181 is rotating in the direction indicated by the arrow R5.

A temperature detection element (not illustrated) detects the temperature of the fixing roller 110.

The contact-sliding member 170 is positioned on the upstream side of the heating nip portion N3 and on the downstream side of the nip portion N2 in the rotational direction R2 of the fixing roller 110. The contact-sliding member 170 includes a pressing member 172, made of a SUS material, and a sliding layer 171 sliding along the surface of the fixing roller 110. A sliding member pressing spring 173 presses the contact-sliding member 170 toward the center of the cored bar 117 of the fixing roller 110 along the direction indicated by an arrow A5. The material for the sliding layer 171 can be selected from fluorine resins (PFA, PTFE, FEP, etc.) having adequate separation properties. It is desired to directly provide a fluorine resin layer, serving as the sliding layer 171, on the pressing member 172. The sliding layer 171 can be a sheet-like member having adequate durability and surface properties. In the present exemplary embodiment, the sliding layer 171 is a PTFE-made layer (a fluorine resin layer having adequate sliding properties) configured into a sheet-like member.

When the pressing force of the sliding member pressing spring 173 is high, the offset toner and the paper dust can be easily mixed at the contact-sliding portion N1. However, the strong pressing force increases the frictional force between the fixing roller 110 and the contact-sliding member 170 and also increases the rotational toque of the fixing roller 110. Therefore, it is desired that the pressing force applied by the sliding member pressing spring 173 be in the range of 5 to 200 N. In the present exemplary embodiment, the pressing force applied by the sliding member pressing spring 173 is set to 49 N. The contact-sliding portion N1 having a width of 4.0 mm is formed.

In the state where the fixing roller 110 and the pressing roller 111 are stably rotating and the temperature of the surface of the fixing roller 110 is maintained at the predetermined fixing temperature based on an output signal from the temperature detection element, the recording material (e.g., recording paper) P carrying an unfixed toner image T reaches the nip portion N2 along the conveyance direction A3. When the recording material P carrying the unfixed toner image T passes through the nip portion N2, the offset toner and the paper dust adhered on the surface of the fixing roller 110 are adequately mixed with each other at the contact-sliding portion N1 between the contact-sliding member 170 and the surface of the fixing roller 110. The offset toner and the paper dust adhered on the surface of the fixing roller 110 can reach the contact-sliding portion N1 when the fixing roller 110 rotates in the direction indicated by the arrow R2.

Figure 16:
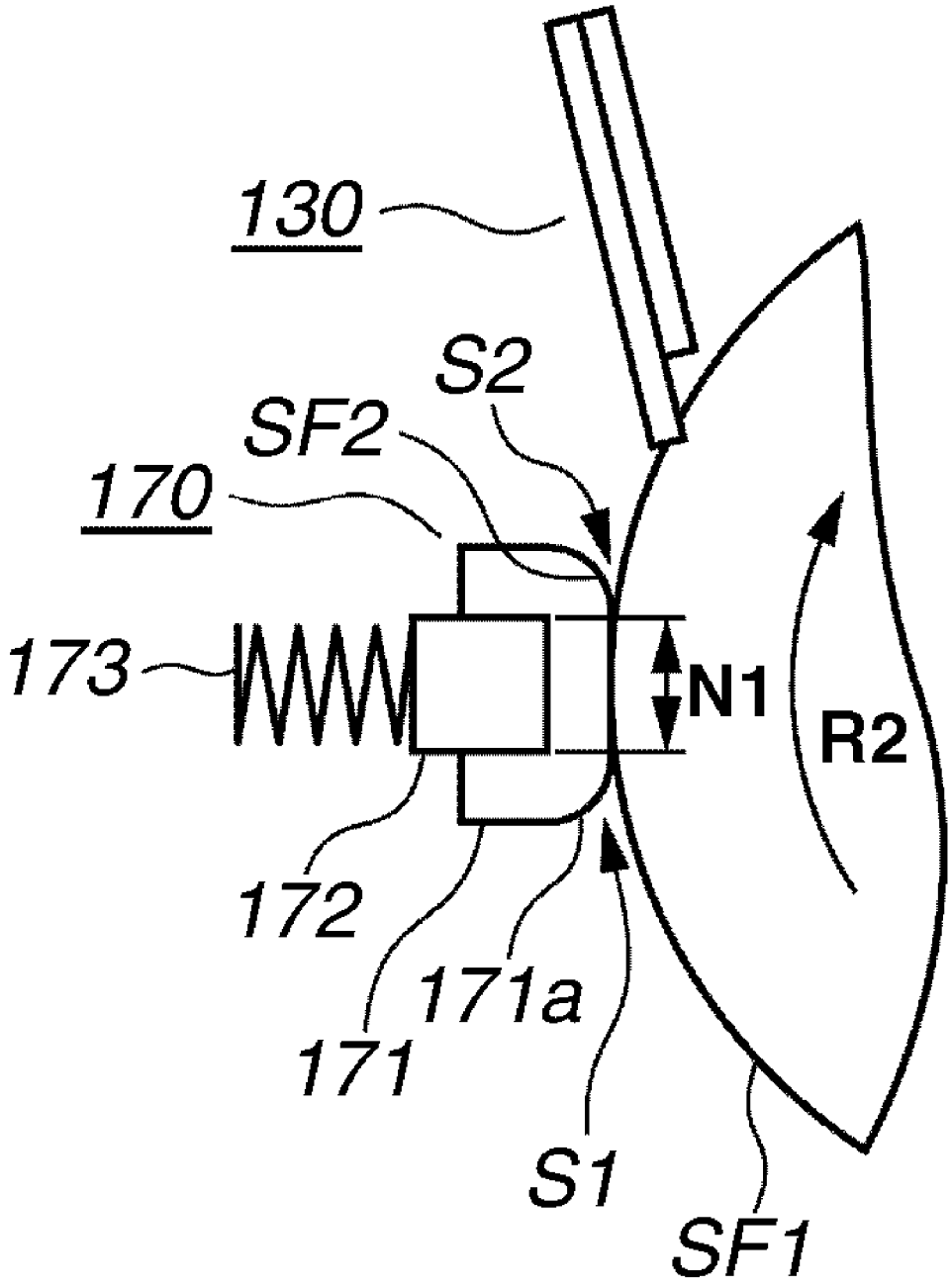
FIG. 16 is an enlarged view illustrating the contact-sliding portion and its vicinity illustrated in FIG. 8.

FIG. 16 is an enlarged view illustrating the contact-sliding portion N1 according to the present exemplary embodiment. The contact-sliding member 170 has a round surface 171*a* on the upstream side thereof in the rotational direction R2 of the fixing roller 110. Therefore, the inlet space S1 is formed at the upstream end of the contact-sliding portion N1 in the rotational direction R2 of the fixing roller 110. Similarly, the outlet space S2 is formed at the downstream end of the contact-sliding portion N1 in the rotational direction R2 of the fixing roller 110.

Therefore, the offset toner and the paper dust, having reached the contact-sliding portion N1, gradually enter the contact-sliding portion N1. The offset toner and the paper dust, having entered the contact-sliding portion, receive the heat from the surface of the fixing roller 110 when they pass through the contact-sliding portion N1. Therefore, the offset toner melts at least partly by the heat from the surface of the fixing roller 110 and is adequately mixed with the paper dust. The offset toner permeates the paper dust.

The paper dust dirt including the permeated offset toner is accumulated on the downstream side of the contact-sliding portion N1 in the rotational direction R2 of the fixing roller 110. If the amount of the paper dust dirt accumulated on the downstream side of the contact-sliding portion N1 increases due to repeated printing, the paper dust dirt is transferred to the surface of the fixing roller 110.

The cleaning member 130 is positioned on the downstream side of the contact-sliding portion N1 and on the upstream side of the nip portion N2 in the rotational direction R2 of the fixing roller 110. In the present exemplary embodiment, the cleaning blade 131 is operable as the cleaning member 130.

Therefore, the cleaning blade 131 scrapes the paper dust dirt, having been transferred from the contact-sliding portion N1 to the surface of the fixing roller 110, off the surface of the fixing roller 110. Thus, the paper dust dirt can be surely removed from the surface of the fixing roller 110.

A print durability test, similar to that described in the first exemplary embodiment, was conducted using the fixing apparatus 100 according to the present exemplary embodiment. In the fixing apparatus 100 according to the present exemplary embodiment, the contact-sliding portion N1 can adequately mix the offset toner with the paper dust adhering on the surface of the fixing roller 110 and let the mixed dirt grow into a larger lump in the outlet space S2. The cleaning blade 131 collects the enlarged lump of the dirt. Therefore, the present exemplary embodiment can prevent the dirt from being discharged (returned) from the cleaning blade 131 to the surface of the fixing roller 110. Thus, in the fixing apparatus 100 according to the present exemplary embodiment, no dirt was confirmed on each recording paper until the number of printed sheets reaches 100,000 corresponding to the endurance life of the fixing apparatus 100.

The rotatable heating member usable by the fixing apparatus 100 according to the present exemplary embodiment is not limited to the heated roller 180. For example, the rotatable heating member can be configured as a film heating type illustrated in FIG. 9.

Figure 9:
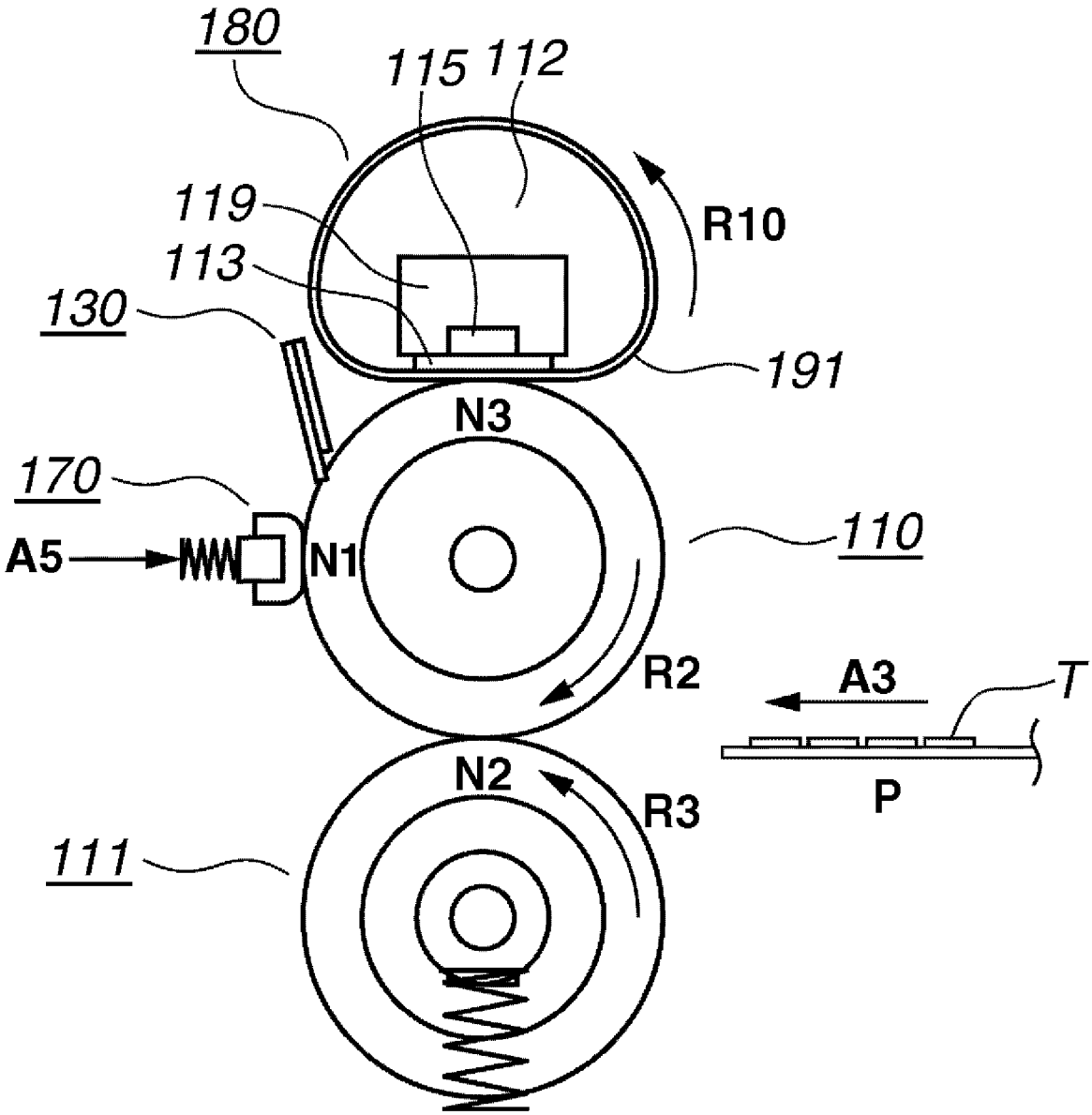
FIG. 9 is a cross-sectional view illustrating a main portion of another fixing apparatus according to the second exemplary embodiment.

FIG. 9 is a cross-sectional view illustrating a main portion of the fixing apparatus 100 according to the present exemplary embodiment.

As illustrated in FIG. 9, the film heating type rotatable heating member 180 includes a thin fixing film 191 (an endless belt), which is loosely coupled around the heater unit 112 of the fixing apparatus 100 described in the first exemplary embodiment. The fixing film 191 has an elongated body extending in longitudinal direction and held at both ends thereof by the pair of side plates 151 of the apparatus frame 150 so as to be rotatable. The pair of pressing springs 114 presses the longitudinal end portions of the heater holder 119 (the heater unit 112) toward the fixing roller 110.

Thus, the lower surface of the heater 113 contacts the surface of the fixing roller 110. The pressing force of the pressing springs 114 causes the elastic layer 116 of the fixing roller 110 to elastically deform to form the heating nip portion N3 having a predetermined width between the outer circumferential surface of the fixing film 191 and the surface of the fixing roller 110. Accordingly, the fixing film 191 is driven by the fixing roller 110 rotating in the direction indicated by the arrow R2 and, therefore, rotates in the direction indicated by an arrow R10. The heating nip portion N3 heats the surface of the fixing roller 110, while the fixing film 191 is rotating in the direction indicated by the arrow R10.

The fixing film 191 of the film heating type fixing apparatus 100 has a heat capacity smaller than that of the heated roller 180 of the above-described heated roller type fixing apparatus 100. Therefore, the film heating type fixing apparatus 100 can reduce the rise time required to increase the temperature of the fixing film 191 to a predetermined temperature and, therefore, can reduce electric power consumption.

In the fixing apparatus 100 according to the present exemplary embodiment, the contact-sliding portion N1 is positioned on the upstream side of the heating nip N1 and on the downstream side of the fixing nip portion N2 in the rotational direction R2 of the fixing roller 110. For example, the cleaning blade 131 can be positioned on the downstream side of the contact-sliding portion N1 and on the upstream side of the nip portion N2 in the rotational direction R2 of the fixing roller 110. In this case, the contact-sliding portion N1 can be positioned on the downstream side of the heating nip portion N3 and on the upstream side of the nip portion N2 in the rotational direction R2 of the fixing roller 110. Functions and effects similar to those of the above-described embodiment can be obtained.

The cleaning member 130 usable in the fixing apparatus 100 according to the present exemplary embodiment is not limited to the cleaning blade 131. For example, similar to the first exemplary embodiment, the cleaning member 130 can be the cleaning pad 1150 or the cleaning roller 160. Similar functions and effects can be obtained.

A fixing apparatus according to a third exemplary embodiment of the present invention is an internal heating type fixing apparatus that includes a heating member configured to heat the fixing roller from the inside. In the present exemplary embodiment, constituent members common to those of the fixing apparatus 100 according to the first exemplary embodiment are denoted by the same reference numerals.

Figure 10:
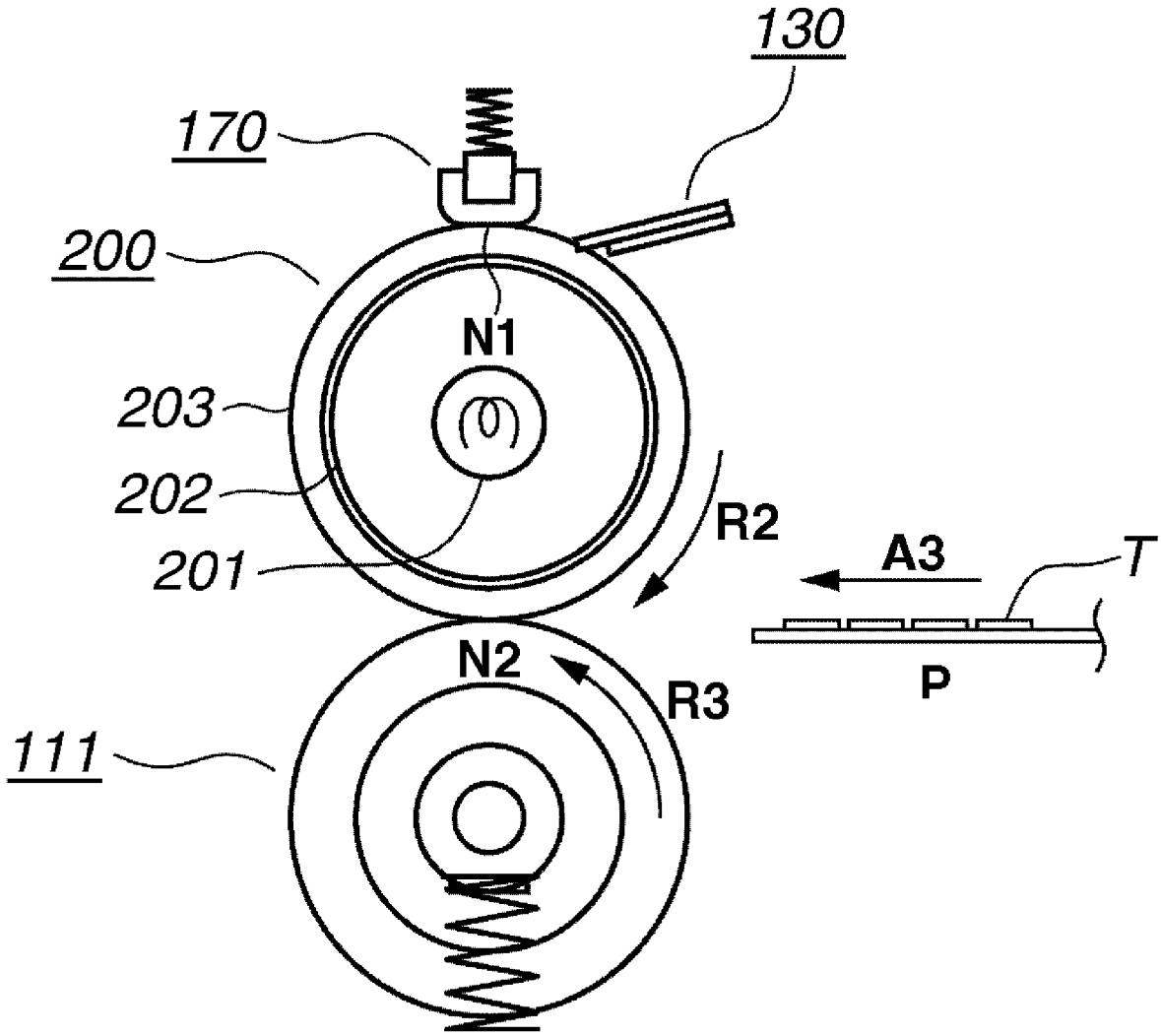
FIG. 10 is a cross-sectional view illustrating a main portion of the fixing apparatus according to the second exemplary embodiment.

FIG. 10 is a cross-sectional view illustrating a main portion of the fixing apparatus 100 according to the present exemplary embodiment.

The fixing apparatus 100 according to the exemplary embodiment is similar to the fixing apparatus 100 according to the first exemplary embodiment in arrangement, except that a cylindrical fixing roller 200 is provided as a rotatable heating member and a halogen heater 201 is disposed in the fixing roller 200.

The fixing roller 200 is a heated roller including a cylindrical iron pipe 202 and an elastic layer 203. The cylindrical iron pipe 202 has an outer diameter of $\phi$16 mm and a thickness of 1 mm, and has an internal space capable of accommodating the halogen heater 201. The elastic layer 203, which is made of a solid silicone rubber and has a thickness of 2 mm, is formed on the outer circumferential surface of the cylindrical iron pipe 202.

The halogen heater 201 has an elongated body extending in the longitudinal direction and held at both ends thereof by the pair of side plates 151 of the apparatus frame 150. The halogen heater 201 can generate radiation heat (radiation energy), when electric power is supplied to halogen heater 201, to heat the fixing roller 200 from the inside.

A temperature detection element (not illustrated) detects the temperature of the fixing roller 200.

The fixing roller 200 has an elongated body extending in the longitudinal direction and held by the pair of side plates 151 via bearings (not illustrated) so as to be rotatable. A radiant paint layer having a higher emissivity is coated on the internal cylindrical surface of the fixing roller 200 (the internal cylindrical surface of the iron pipe 202), so that the radiation energy emitted from the halogen heater 182 can be effectively absorbed. A PFA-made layer, having excellent separation properties, is coated on the outer circumferential surface of the elastic layer 203. The PFA-made layer can prevent the dirt from adhering on the outer surface of the elastic layer 203.

The pressing roller 111 is positioned below the fixing roller 200 and is disposed in parallel with the fixing roller 200. The cored bar 121 has an elongated body extending in the longitudinal direction and supported at both ends thereof by the pair of side plates 151 via the bearings 125 to as to be rotatable. The pressing springs 124, pressing the bearings 125 in the upward direction A2, apply a predetermined pressing force to the pressing roller 111. Thus, the surface of the pressing roller 111 contacts the outer circumferential surface of the fixing roller 200. The pressing force of the pressing springs 124 causes the elastic layer 122 of the pressing roller 111 and the elastic layer 203 of the fixing roller 200 to elastically deform to form the nip portion N2 having a predetermined width between the surface of the pressing roller 111 and the surface of the fixing roller 200.

In the state where the fixing roller 200 and the pressing roller 111 are stably rotating and the temperature of the surface of the fixing roller 200 is maintained at the predetermined fixing temperature based on an output signal from the temperature detection element, the recording material carrying an unfixed toner image T reaches the nip portion N2 along the conveyance direction A3. When the recording material (e.g., recording paper) P carrying unfixed toner image T passes through the nip portion N2, the offset toner and the paper dust adhering on the surface of the fixing roller 200 are adequately mixed with each other at the contact-sliding portion N1 between the contact-sliding member 170 and the surface of the fixing roller 110. The offset toner and the paper dust adhered on the surface of the fixing roller 200 can reach the contact-sliding portion N1 when the fixing roller 200 rotates in the direction indicated by the arrow R2.

In the present exemplary embodiment also, the inlet space and the outlet space are provided at the upstream end and the downstream end of the contact-sliding portion N1. Therefore, the offset toner and the paper dust having reached the contact-sliding portion N1 gradually enter the contact-sliding portion N1. The offset toner and the paper dust, having entered the contact-sliding portion N1, receive the heat from the surface of the fixing roller 200 and are mixed together. The offset toner, which melts at least partly by the heat from the surface of the fixing roller 200, permeates the paper dust, while it passes through the contact-sliding portion N1.

The paper dust dirt including the permeated offset toner is accumulated on the downstream side of the contact-sliding portion N1 in the rotational direction R2 of the fixing roller 200. If the amount of the paper dust dirt accumulated on the downstream side of the contact-sliding portion N1 increases due to repeated printing, the paper dust dirt is transferred to the surface of the fixing roller 200.

The cleaning member 130 is positioned on the downstream side of the contact-sliding portion N1 and on the upstream side of the nip portion N2 in the rotational direction R2 of the fixing roller 200. In the present exemplary embodiment, the cleaning blade 131 serves as the cleaning member 130. Therefore, the cleaning blade 131 scrapes the paper dust dirt, having been transferred from the contact-sliding portion N1 to the surface of the fixing roller 200, off the surface of the fixing roller 200. Thus, the paper dust dirt can be surely removed from the surface of the fixing roller 200.

A print durability test, similar to that described in the first exemplary embodiment, was conducted using the fixing apparatus 100 according to the present exemplary embodiment. In the fixing apparatus 100 according to the present exemplary embodiment, the contact-sliding portion N1 can adequately mix the offset toner with the paper dust adhering on the surface of the fixing roller 200 and let the mixed dirt grow into a larger lump in the outlet space. The cleaning blade 131 collects the enlarged lump of the dirt. Therefore, the present exemplary embodiment can prevent the dirt from being discharged (returned) from the cleaning blade 131 to the surface of the fixing roller 200. Thus, in the fixing apparatus 100 according to the present exemplary embodiment, no dirt was confirmed on each recording paper until the number of printed sheets reaches 100,000 corresponding to the endurance life of the fixing apparatus 100.

The cleaning member 130 usable in the fixing apparatus 100 according to the present exemplary embodiment is not limited to the cleaning blade 131. For example, similar to the first exemplary embodiment, the cleaning member 130 can be the cleaning pad 1150 or the cleaning roller 160. Similar functions and effects can be obtained.

Figure 11:
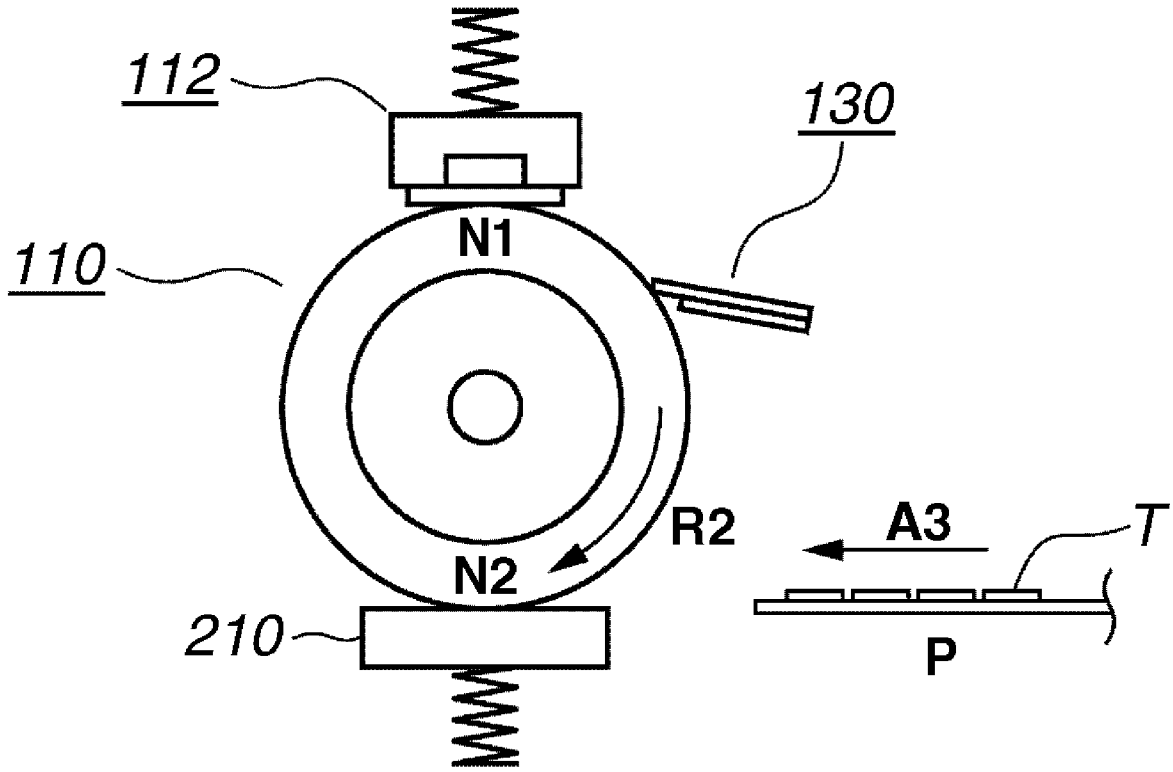
FIG. 11 is a cross-sectional view illustrating a main portion of a fixing apparatus, which uses a pad member as an example back-up member.

FIG. 11 is a cross-sectional view illustrating a main portion of a fixing apparatus, which uses a pad member 210 serving as an example back-up member.

The back-up member usable in the fixing apparatus 100 according to the first to third exemplary embodiments is not limited to the pressing roller 111. For example, the pad member 210 illustrated in FIG. 11 is a non-rotatable type capable of operating as the back-up member.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Applications No. 2008-022717 filed Feb. 1, 2008 and No. 2008-330372 filed Dec. 25, 2008, which are hereby incorporated by reference herein in their entirety.

What is claimed is:

1. An image heating apparatus for heating a toner image formed on a recording medium, the image heating apparatus comprising:

a heating roller configured to contact the toner image on the recording medium to heat the toner image;

a back-up member configured to contact a surface of the heating roller to form a heating nip portion together with the heating roller, so that the recording medium is held between the heating roller and the back-up member and conveyed in a predetermined conveyance direction;

a heater having a length in a direction parallel to a generatrix of the heating roller, which is not smaller than the width of a maximum recording medium that can be processed by the image heating apparatus, and configured to contact the surface of the heating roller, wherein a contact surface of the heater contacting the surface of the heating roller is a non-movable surface, wherein an inlet space is formed between the surface of the heating roller and the contact surface of the heater on the upstream side of a contact area between the surface of the heating roller and the heater in the rotational direction of the heating roller, and an outlet space is formed between the surface of the heating roller and the contact surface of the heater on the downstream side of the contact area in the rotational direction; and a cleaning member positioned on the downstream side of the outlet space and on the upstream side of the heating nip portion in the rotational direction and configured to contact the surface of the heating roller.

2. An image forming apparatus comprising:

an image forming unit configured to form a toner image on a recording medium; and the image heating apparatus according to claim 1, the image heating apparatus configured to heat the toner image on the recording medium.

* * * * *